US012078029B2

(12) United States Patent
Li et al.

(10) Patent No.: US 12,078,029 B2
(45) Date of Patent: Sep. 3, 2024

(54) WIRELINE AUTOMATION SYSTEMS AND METHODS

(71) Applicant: Schlumberger Technology Corporation, Sugar Land, TX (US)

(72) Inventors: Jisheng Li, Sugar Land, TX (US); Yang Hu, Sugar Land, TX (US); Thomas Mauchien, Sugar Land, TX (US); Benjamin Jean Yvon Durand, Sugar Land, TX (US); Xuedong Yang, Sugar Land, TX (US); Richard Woods, Houston, TX (US); Tzy Yu Chow, Sugar Land, TX (US); Amanda Olivio, Tomball, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/045,292

(22) Filed: Oct. 10, 2022

(65) Prior Publication Data

US 2023/0296001 A1 Sep. 21, 2023

Related U.S. Application Data

(60) Provisional application No. 63/289,462, filed on Dec. 14, 2021.

(51) Int. Cl.
*E21B 34/14* (2006.01)
*E21B 23/00* (2006.01)

(52) U.S. Cl.
CPC ..... *E21B 34/14* (2013.01); *E21B 23/00* (2013.01)

(58) Field of Classification Search
CPC ..... E21B 23/04; E21B 47/09; G06F 3/00
See application file for complete search history.

(56) References Cited

U.S. PATENT DOCUMENTS 5,549,161 A 8/1996 Gomez et al.
6,378,627 B1 4/2002 Tubel
8,220,555 B1 7/2012 Wintill et al.
(Continued)

FOREIGN PATENT DOCUMENTS

CN 208777937 4/2019
EP 2665893 A4 4/2019
(Continued)

OTHER PUBLICATIONS

Foucher et al., 2018, Wireline Tractor Advanced Restriction Navigation, SPE-189926-MS, (6 pages).
(Continued)

*Primary Examiner* — Tara Schimpf
*Assistant Examiner* — Ursula Lee Norris
(74) *Attorney, Agent, or Firm* — Jeffrey D. Frantz

(57) ABSTRACT

A wireline shifting tool comprising an anchor, a linear actuator, and a shifter may be at least partially controlled by one or more measurements indicating an amount of force applied to the anchor, the linear actuator, the shifter, or a combination thereof. For example, a processor may receive the one or more measurements and perform a seeking operation or cause a graphical user interface (GUI) to display information that may inform a user regarding operations associated with the wireline shifting tool.

20 Claims, 21 Drawing Sheets

(56) References Cited

U.S. PATENT DOCUMENTS

| | | | | |
|---|---|---|---|---|
| 10,151,162 | B2 | 12/2018 | Getzlaf | |
| 2001/0027866 | A1 | 10/2001 | George | |
| 2005/0072577 | A1 | 4/2005 | Freeman | |
| 2007/0251687 | A1 | 11/2007 | Martinez | |
| 2013/0014939 | A1 | 1/2013 | Martinez et al. | |
| 2013/0118762 | A1 | 5/2013 | Kellner | |
| 2014/0083680 | A1* | 3/2014 | Brekke | E21B 44/005 166/308.1 |
| 2014/0083708 | A1 | 3/2014 | Beck et al. | |
| 2014/0174761 | A1* | 6/2014 | Spencer | E21B 17/1014 166/381 |
| 2016/0053562 | A1 | 2/2016 | Frosell et al. | |
| 2016/0090803 | A1 | 3/2016 | Getzlaf | |
| 2017/0058644 | A1 | 3/2017 | Andreychuk | |
| 2017/0175469 | A1 | 6/2017 | Murphy | |
| 2017/0370189 | A1 | 12/2017 | MacDougall | |
| 2018/0051529 | A1* | 2/2018 | Braaten | E21B 21/10 |
| 2018/0171790 | A1* | 6/2018 | Sharma | E21B 49/10 |
| 2020/0040679 | A1 | 2/2020 | Mauchien et al. | |
| 2020/0173258 | A1* | 6/2020 | MacDougall | E21B 47/092 |
| 2021/0189820 | A1 | 6/2021 | Baklanov et al. | |

FOREIGN PATENT DOCUMENTS

| | | | |
|---|---|---|---|
| WO | WO2013074092 | A1 * | 5/2013 |
| WO | 2018004575 | A2 | 1/2018 |
| WO | 2021225967 | A1 | 11/2021 |

OTHER PUBLICATIONS

Bi-Directional Shifting Tool, downloaded on May 13, 2021, at http://www.hunting-intl.com/well-intervention-equipment/thru-tubing-technology/fishing-tools/bi-directional-shifting-tool (1 page).

European Extended Search Report issued in EP20215643.6, dated Apr. 21, 2021 (7 pages).

International Search Report and Written Opinion issued in International Patent application PCT/2021/030492 on Jun. 28, 2021, 9 pages.

International Preliminary Report on Patentability issued in International Patent application PCT/US2021/030492, dated Nov. 10, 2022, 7 pages.

Office Action issued in U.S. Appl. No. 17/126,071 on Apr. 12, 2022, 9 pages.

International Search Report and Written Opinion issued in PCT Application No. PCT/US2022/048945 dated Mar. 10, 2023, 11 pages.

Office Action issued in U.S. Appl. No. 17/997,662 dated Feb. 22, 2024, 31 pages.

Extended Search Report issued in European Patent Application No. 21799493.I8 dated Mar. 15, 2024, 5 pages.

* cited by examiner

62

Completion Mapping

| Depth(ft) | ID(in) | OD(in) | QT | Description |
|---|---|---|---|---|
| 5920.15 | 2.992 | 6.07 | 8 | Pup Jt |
| 5930.22 | 2.813 | 3.66 | 1 | Sliding Sleeve |
| 5980 | 0 | 0 | 1 | |
| 5980.15 | 2.992 | 6.07 | 8 | Pup Jt |
| 6002.22 | 2.813 | 3.66 | 1 | Sliding Sleeve |
| 6013.88 | 2.992 | 4.01 | 1 | Pup Jt |
| 6017.89 | 2.392 | 7.01 | 2 | Tubing |
| 6030.56 | 3.121 | 8.12 | 5 | Pup Jt |
| 6065.11 | 2.992 | 6.07 | 1 | Sliding Sleeve |
| 6070.11 | 0 | 0 | 1 | |

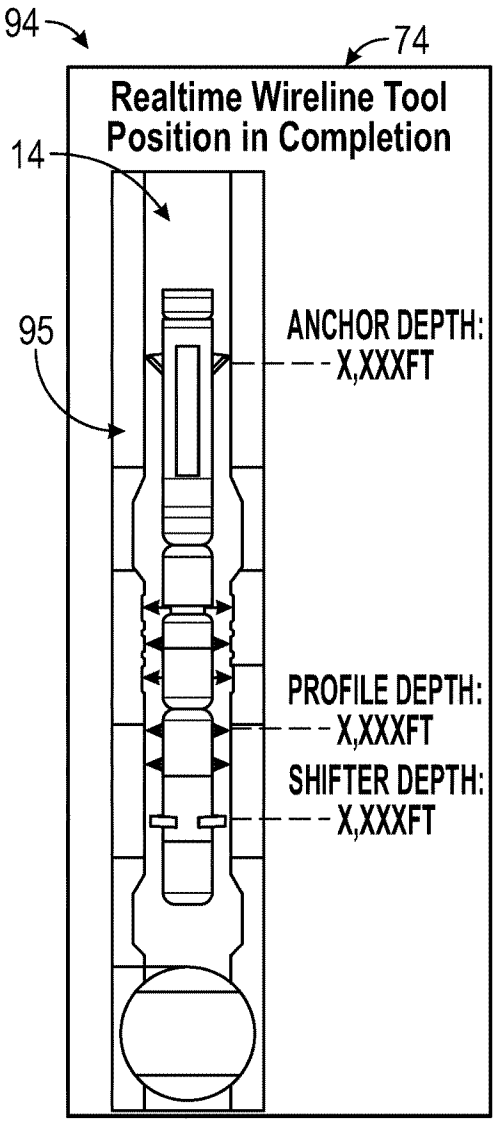
FIG. 11A
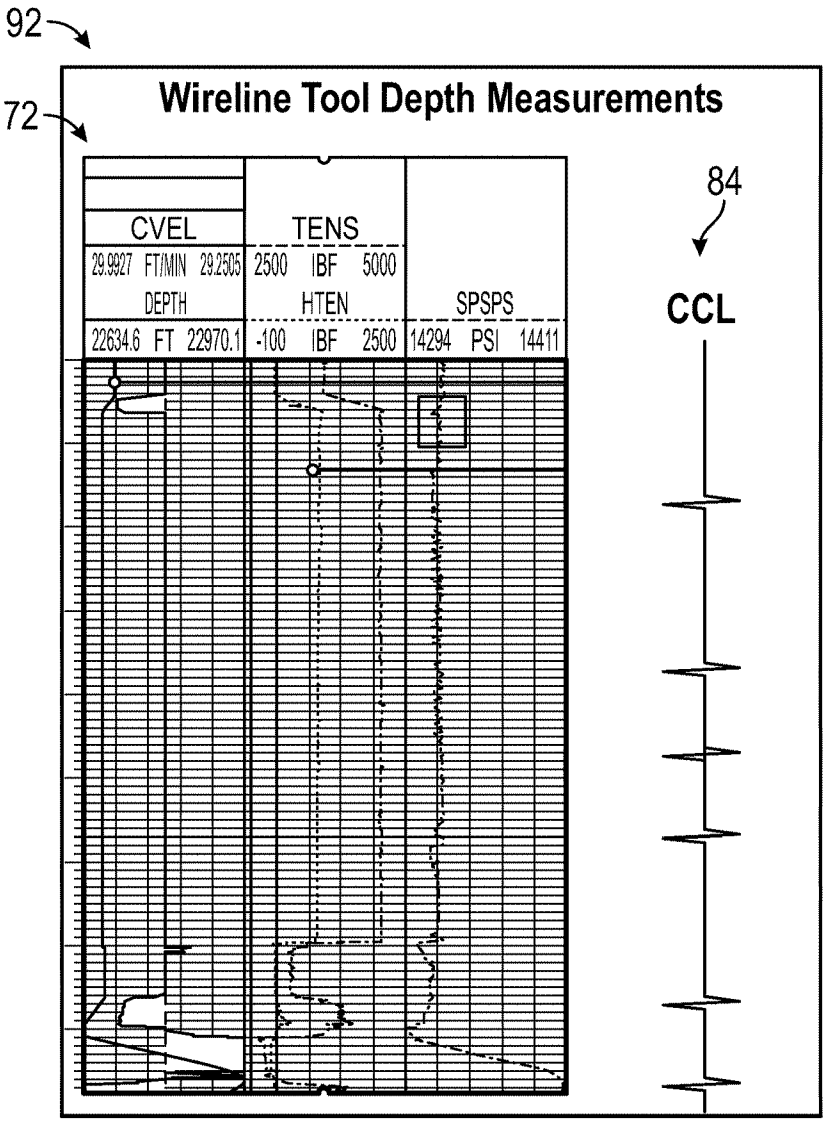
FIG. 11B
FIG. 11C

210

SHIFTING DELIVERABLE LOGGING

| TIME STAMP | OPERATION | TOOL | OPERATION STATUS | DEPTH (ft) | AVG FORCE (lbf) | MAX FORCE (lbf) | INIT HPPR PRESSURE (psi) | INIT ANCHOR DIAMETER (in) | INIT LINEAR ACTUATOR POSITION(IN) | END HPPR PRESSURE (psi) | END ANCHOR DIAMETER (in) | END LINEAR ACTUATOR POSITION(in) |
|---|---|---|---|---|---|---|---|---|---|---|---|---|
| 5/5/2021 10:11:15 AM | UPDATED COMPLETION COMPONENT INFORMATION | ALL | CMP_COM_DESC: \| CMP_COM_MAFA: \| CMP_COM_PN: \| CMP_COM_SIZE: 0.000000 \| CMP_COM_TYPE: | NaN | NaN | NaN | NaN | NaN | NaN | NaN | NaN | NaN |
| 5/5/2021 10:21:04 AM | OPEN ANCHOR WITH FORCE LIMIT 1500.00 lbf AND DIAMETER LIMIT 5.12 in | SPANS-AA | STOPPED | 9979.8 | 573 | 1143 | 812 | 2.13 | NaN | 12 | 4.41 | NaN |
| 5/5/2021 10:21:44 AM | CLOSE ANCHOR WITH FORCE LIMIT 1500.00 lbf AND DIAMETER LIMIT 2.13 in | SPANS-AA | SUCCEEDED | 9979.8 | -753 | -1497 | 812 | 4.4 | NaN | 812 | 2.12 | NaN |

212 214 216

FIG. 20

WIRELINE AUTOMATION SYSTEMS AND METHODS

CROSS-REFERENCE TO RELATED APPLICATION

This application claims priority to and the benefit of U.S. Provisional Patent Application Ser. No. 63/289,462, entitled "Wireline Automation Systems and Methods," filed Dec. 14, 2021, which is hereby incorporated by reference in its entirety for all purposes.

BACKGROUND

The present disclosure relates generally to wireline automation systems. More specifically, the present disclosure relates to techniques to improve the accuracy and rate of positioning downhole shifting tools.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A wireline shifting tool (i.e., part of a wireline shifting tool string) generally includes one or more anchor modules, a linear actuator module, and a shifter having a shifter key with a shifter profile that matches a target profile at a target location (e.g., depth). In operation, a downhole shifting tool string is positioned at or near a target location (i.e., positioning the shifter within a suitable position relative to the shifting target), where the shifter key may latch or couple to the target profile that matches the shifter profile. However, positioning the downhole shifting tool is a relatively difficult procedure as the positioning is performed downhole where it is difficult to determine a location of the shifter relative to the target location. Accordingly, it may be advantageous to improve the accuracy of determining the location of the shifter relative to the target location.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, the present disclosure relates to a system. The system includes a wireline shifting tool includes an anchor and a shifter. The system also includes a wireline shifting tool control system that receives one or more measurements associated with the wireline shifting tool and adjusts operation of the wireline shifting tool based on the one or more measurements.

In one embodiment, the present disclosure relates to a method. The method includes receiving, via a processor, one or more parameters indicating an amount of force to be applied to a wireline shifting tool. The method also includes adjusting, via the processor, operation of the wireline shifting tool. Further, the method includes receiving, via the processor, an indication of a force applied to a component of the wireline shifting tool. Even further, the method includes determining, via the processor, that the force applied to the component exceeds a threshold. Further still, the method includes setting, via the processor, a shifter of the wireline shifting tool based on the force applied to the component exceeding the threshold.

In one embodiment, the present disclosure relates to a non-transitory computer-readable medium comprising computer-executable instructions that, when executed by a processor, cause the processor to receive one or more parameters indicating an amount of force to be applied to a wireline shifting tool. The instructions, when executed by the processor, also cause the processor to determine an operational adjustment to be made to the wireline shifting tool based on the one or more parameters. Further, the instructions, when executed by the processor, cause the processor to display a graphical user interface (GUI) comprising information associated with the operational adjustment. Further still, the instructions, when executed by the processor, cause the processor to adjust operation of the wireline shifting tool in accordance with the operational adjustment and the information displayed on the GUI.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 11A is a screenshot of a GUI displaying a second example of processed completion map, in accordance with aspects of the present disclosure;

FIG. 11B is a screenshot of a GUI displaying an example of wireline depth measurements, in accordance with aspects of the present disclosure;

FIG. 11C is a screenshot of a GUI displaying a second example of data corresponding to the wireline position output, in accordance with aspects of the present disclosure;

FIG. 20 is a screenshot of a GUI displaying data corresponding to a wireline operational report, in accordance with aspects of the present disclosure;

DETAILED DESCRIPTION

Figure 1:
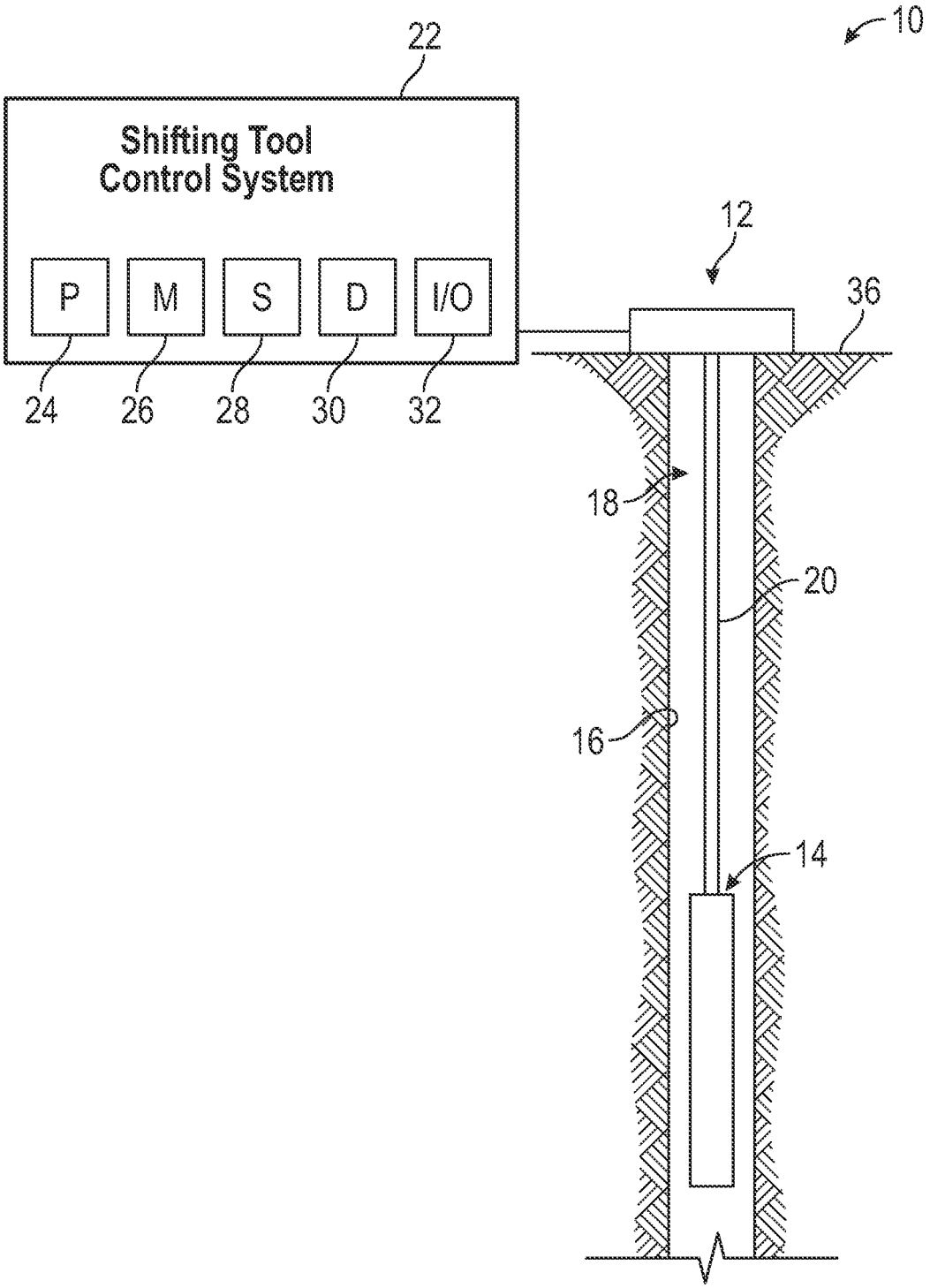
FIG. 1 is schematic diagram of a wireline shifting tool system, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and enterprise-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

As used herein, the term "computing system" refers to an electronic computing device such as, but not limited to, a single computer, virtual machine, virtual container, host, server, laptop, and/or mobile device, or to a plurality of electronic computing devices working together to perform the function described as being performed on or by the computing system. As used herein, the term "medium" refers to one or more non-transitory, computer-readable physical media that together store the contents described as being stored thereon. Embodiments may include non-volatile secondary storage, read-only memory (ROM), and/or random-access memory (RAM). As used herein, the term "application" refers to one or more computing modules, programs, processes, workloads, threads and/or a set of computing instructions executed by a computing system. Example embodiments of an application include software modules, software objects, software instances and/or other types of executable code.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequently, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment.

In addition, as used herein, the terms "automatic", "automated", "autonomous", and so forth, are intended to describe operations that are performed are caused to be performed, for example, by a computing system (i.e., solely by the computing system, without human intervention). Indeed, it will be appreciated that the data processing systems and control systems described herein may be configured to perform any and all of the data processing and control functions described herein automatically.

As mentioned above, a wireline shifting tool string (e.g., downhole shifting tool string) generally includes one or more anchor modules, a linear actuator module (e.g., linear actuator), and a shifter having a shifter key with a shifter profile that matches a target profile at a target location (e.g., depth) corresponding to a sliding sleeve. In operation, a wireline shifting tool string (i.e., having one or more wireline shifting tools) is positioned at or near a target location (i.e., positioning the shifter within a suitable position relative to the shifting target), where the shifter key may latch or couple to the target profile that matches the shifter profile. Due to the difficulty in determining the relative position of the wireline shifting tool, an operator or control system that controls the position of the downhole shift tool may miss the collar joint, take longer than an average time to finding the location corresponding to the target depth, perform the operation at the wrong location (i.e., a location not including the target profile), and other operations that may be inefficient. It is presently recognized that it may be advantageous to generate a wireline position output that provides a visualization of a wireline shifting tool string and/or a particular wireline shifting tool, a relative distance between the wireline shifting tool and the target location, and may enable control of the wireline shifting tool as it approaches the target location. Further still, it may be advantageous to improve techniques for latching a shifter key via its shifter profile to a target profile.

Accordingly, the present disclosure relates to improving the accuracy and rate of positioning downhole shifting tools (e.g., smart shifting tool, a selective shifting tool, or a completion shifting tool). In general, the disclosed techniques may include generating a wireline position output that provides a visualization (e.g., via a graphical user interface (GUI)) that is more discernable to a user and/or provides improved control of the wireline shifting tool. For example, and as discussed in further detail herein, the wireline position output may include a composite depth log, a determined shifter parameter (e.g., a shift opener diameter), a shifting tool operational report, and/or a control signal that modifies operation of one or more components of the downhole shifting tools. In some embodiments, the visualization may be based on shifting tool dimension information to show a relative position between shifting tools and certain elements (e.g., anchor, shifter, and the like) and well completion elements. In some embodiments, the disclosed techniques involve generating a wireline operational report for use in certain oil and gas operations. In some embodiments, the disclosed techniques involve adjusting operation of a solenoid used in downhole shifting operations. In this way, the present disclosure may improve the efficiency of certain oil and gas operations associated with downhole shifting tools.

With the foregoing in mind, FIG. 1 illustrates a shifting tool adjustment system 10 that may employ the systems and methods of this disclosure. The wireline shifting tool adjustment system 10 may include a conveyance device 12 that may be used to convey a wireline shifting tool 14 (e.g., downhole shifting tool) through a geological formation 16 via a borehole 18. In the example of FIG. 1, the wireline shifting tool 14 is conveyed on a cable 20 via the conveyance device 12. Any suitable cable 20 for well logging may be used. The cable 20 may be spooled and unspooled on a drum and an auxiliary power source (not shown) may provide energy to the wireline shifting tool 14.

In general, the wireline shifting tool 14 is conveyed using the conveyance device 12 based on operation of a shifting tool control system 22. The wireline shifting tool control system 22 may be any electronic data processing system that can be used to carry out the systems and methods of this disclosure. For example, the wireline shifting tool control system 22 may include a processor 24, which may execute instructions stored in memory 26 and/or storage 28. As such, the memory 26 and/or the storage 28 of the wireline shifting tool control system 22 may be any suitable article of manufacture that can store the instructions. The memory 26 and/or the storage 28 may be read-only memory (ROM), random-access memory (RAM), flash memory, an optical storage medium, or a hard disk drive, to name a few examples. A display 30, which may be any suitable electronic display, may display images generated by the processor 24. In general, the display 30 may facilitate users to view images generated on the wireline shifting tool control system 22. For example, the processor 24 may cause the display 30 to display a graphical user interface (GUI) that depicts information associated with the wireline shifting tool (e.g., completion map data, a processed completed map, wireline depth tool measurements, a wireline position output, and the like). In some embodiments, the display 30 may include a touch screen, which may facilitate user interaction with a user interface of the wireline shifting tool control system 22. Furthermore, it should be appreciated that, in some embodiments, the display 30 may include one or more liquid crystal displays (LCDs), light-emitting diode (LED) displays, organic light-emitting diode (OLED) displays, active-matrix organic light-emitting diode (AMOLED) displays, or some combination of these and/or other display technologies. In some embodiments, the display 30 may be implemented on a computing device associated with the user (e.g., an external computing device), such as a laptop, tablet, or mobile device. The wireline shifting tool control system 22 also includes input/output (I/O) ports 32. The I/O ports 32 may be interfaces that may couple to other peripheral components such as input devices (e.g., keyboard, mouse), input/output (I/O) modules, and the like. Additionally, the wireline shifting tool controller system 22 includes a wireline acquisition system (WAS). In general, the WAS may include a processor and/or memory for transmitting instructions to control wireline components, receive downhole measurements, analyze the downhole measurements, and storing results of the analysis.

The wireline shifting tool 14 includes an electronic device having a processor and memory that is capable of performing control actions. In some embodiments, the downhole device may include sensors for formation and/or production measurements, a tractor for conveyance, or include mechanical mechanisms to operate completion control elements, such as sliding sleeves, safety valves, and the like. For example, the wireline shifting tool 14 may include a sensor in various modules of the wireline shifting tool 14; however, it should be appreciated that any suitable conveyance may be used. For example, the downhole device may be a tractor or any suitable downhole tool that may perform a variety of operations downhole. For example, the wireline shifting tool 14 may include or be coupled to a tractor that enables the wireline shifting tool to traverse the borehole 18 or may obtain measurements of the geological formation 16 using a sensor (e.g., a neutron sensor, an x-ray or gamma-ray spectroscopy sensor, an image sensor such as a camera). In some embodiments, the wireline shifting tool 14 a downhole tractor, drilling tools (i.e., non-wireline), acquisition/sampling tools or other devices having components that may be mechanically actuated based on control signals (e.g., generated by the downhole device 12).

In general, the wireline shifting tool 14 may include generally similar features as the wireline shifting tool control system 22. For example, the downhole device may include a processor, which may execute instructions stored in memory and/or storage. As such, the memory and/or the storage of the wireline shifting tool 14 may be any suitable article of manufacture that can store the instructions. The memory and/or the storage may be read-only memory (ROM), random-access memory (RAM), flash memory, an optical storage medium, or a hard disk drive, to name a few examples. The processor, memory, and/or storage may be a local component of the downhole device (e.g., within a housing of the wireline shifting tool 14).

Figure 2:
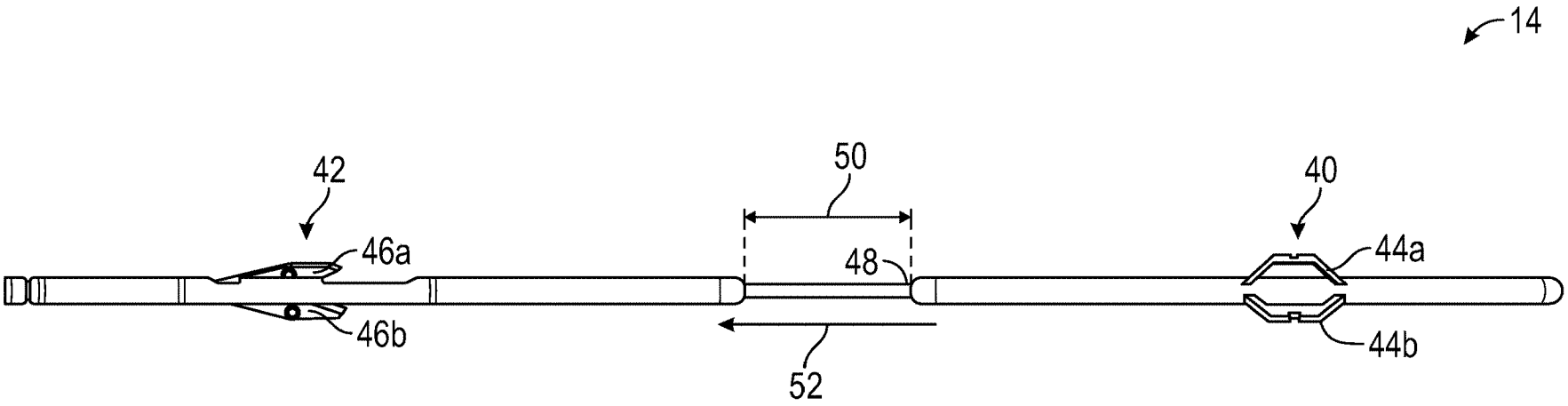
FIG. 2 is a perspective view of a wireline shifting tool that may be utilized in the wireline shifting tool system of FIG. 1, in accordance with aspects of the present disclosure.

To further illustrate components of the wireline shifting tool 14, FIG. 2 shows a schematic diagram of the wireline shifting tool 14. In the illustrated embodiment, the wireline shifting tool 14 includes a shifter section 40 and an anchor section 42. As illustrated, the shifter section 40 includes one or more shift devices 44 (e.g., 44*a* and 44*b*) that are generally capable of expanding radially from the wireline shifting tool 14 to a fully expanded shifter position and retracting to a retracted shifter position. As further illustrated, the anchor section 42 includes one or more anchor devices 46 (e.g., 46*a* and 46*b*) that are generally capable of expanding radially from the wireline shifting tool 14 to a fully expanded anchor position and retracting to a retracted anchor position. As described herein, the one or more shift devices 44 (e.g., a shifter key, a shifter, or a shifter device) include a shifter profile that matches a target profile at a target location (e.g., depth) along a borehole 18. In operation, a downhole shifting tool string including the wireline shift tool 14 is positioned at or near a target location (i.e., positioning the shifter within a suitable position relative to the shifting target), where the one or more shift devices 44 may latch or couple to the target profile that matches the shifter profile of the one or more shift devices 44. As described in more detail herein, the wireline shifting tool 14 is capable of extending via a linear actuator to a distance 50 along a longitudinal axis 52 that may run along a depth of the borehole.

Figure 3:
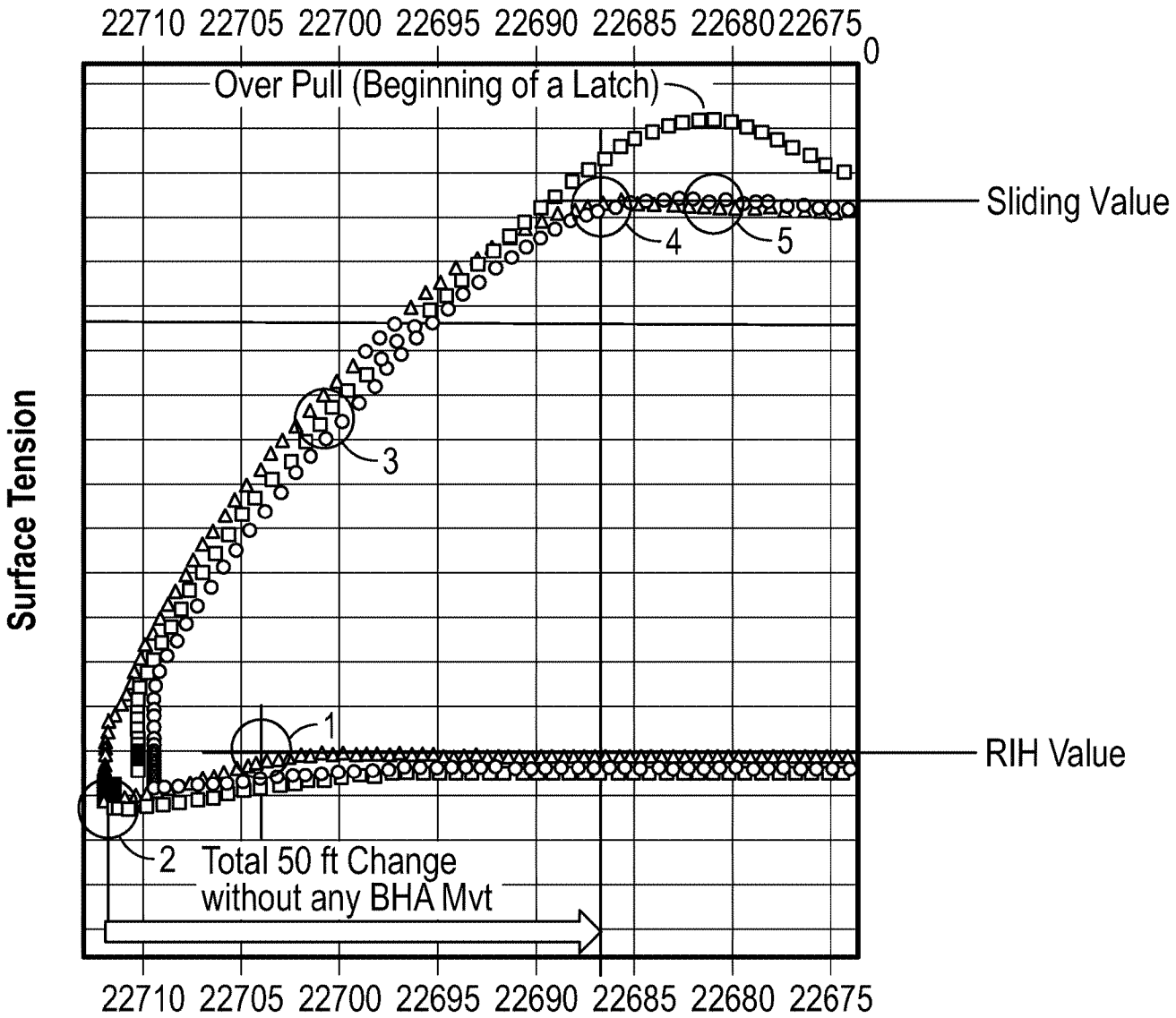
FIG. 3 shows a graph illustrating a discrepancy that may result from a winch depth measurement, in accordance with aspects of the present disclosure.

FIG. 3 shows a graph illustrating a discrepancy between a winch depth measurement obtained from a surface measurement device. In particular, FIG. 3 illustrates a different tag and pick up (blue, green, and brown). The point where a bottom hole assembly (BHA) leaves the ground may not be defined precisely. At this depth elasticity of the cable make surface measurement (on the winch) disconnected from downhole status.

Figure 4:
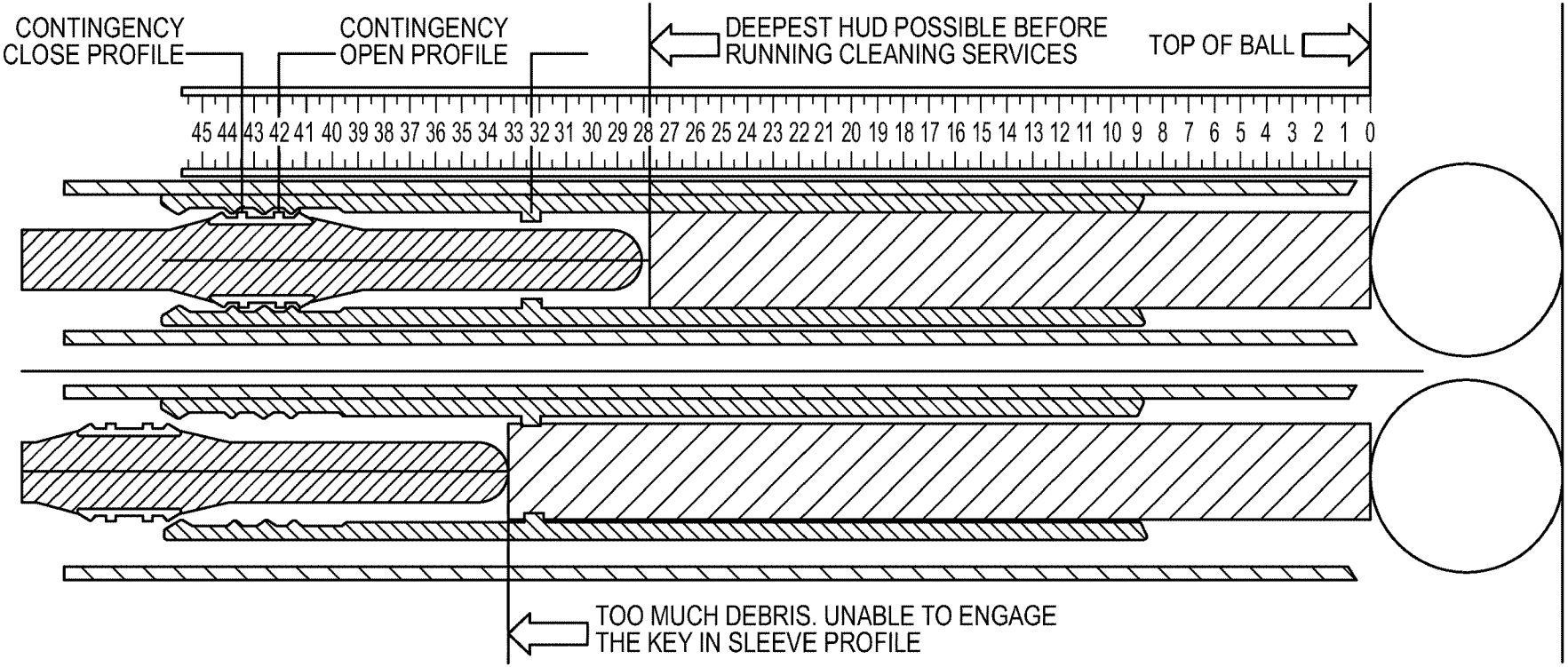
FIG. 4 shows a schematic diagram of a shifting operation, in accordance with aspects of the present disclosure.

FIG. 4 shows a schematic diagram of a shifting operation. In particular, FIG. 4 illustrates a reason for accurate depth determination. For example, an isolation valve may provide little tolerance on debris. When engaging into planning a ball shifting operation the holdup depth (HUD) is the very first step to be planned. It determines if cleaning services may be implemented. We here are making a macro view on downhole interaction. The success of shifting may be related to assurance that the key can reach its profile hence precisely defining the HUD.

Figure 5:
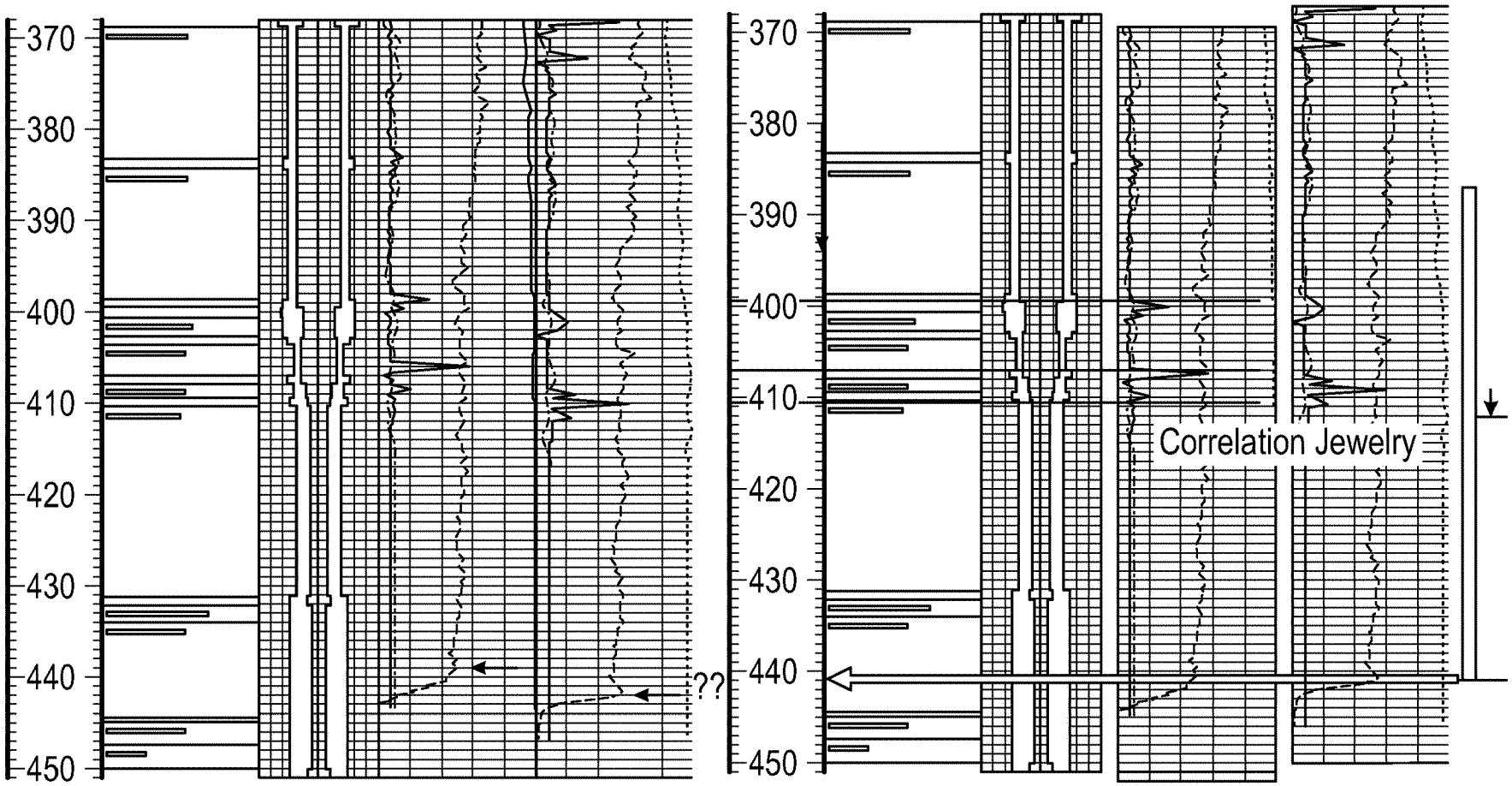
FIG. 5 shows well logs illustrating hysteresis between two downhole passes, in accordance with aspects of the present disclosure.

FIG. 5 shows well logs illustrating hysteresis between two downhole passes. As show, at least in some embodiments, although more than 25,000-28,000 feet (e.g., between 7620 meter-8535 meter) of cable potential stretch was deemed to be covered by the pip tag reference, the two correlated pip tag demonstrate the hysteresis of at least 3 feet over a travel of 100 feet (e.g., approximately 30.5 meter) from a known reference. On the right, the same two down pass tags were correlated to the deepest known element from the lower completion leaving only 3 ft (e.g., approximately 1 meter) to the counterwheel. The conclusion is that casing collar locator (CCL) combined with head tension may provide a more accurate HUD. Additional measurements to the surface tension measurements may bring enough variation to reach this level of accuracy.

Figure 6:
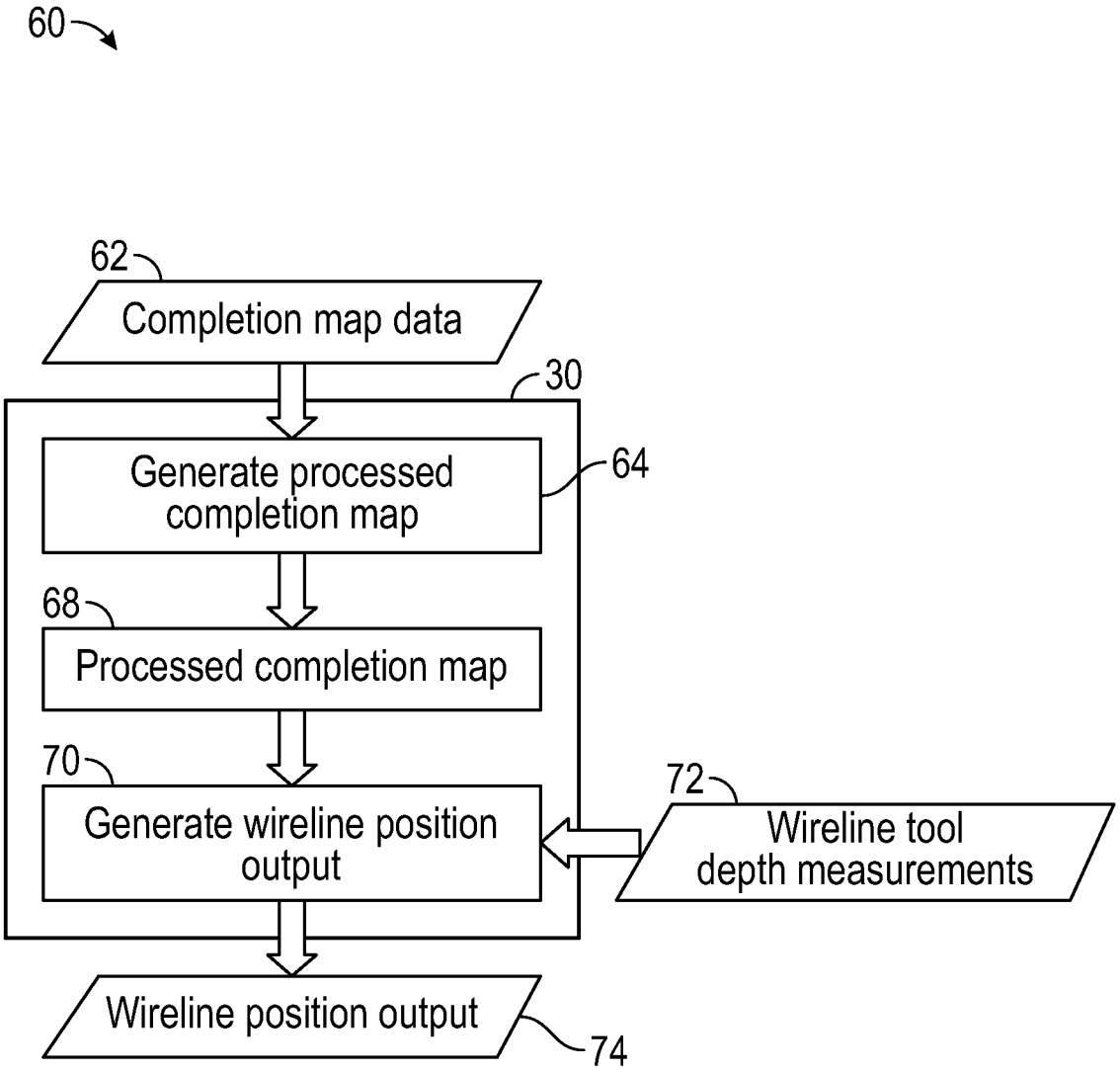
FIG. 6 is a flow diagram of a method for generating a wireline position output, in accordance with aspects of the present disclosure.

As described herein, aspects of the present disclosure include generating a wireline position output that generally correlates depth with one or more additional data (e.g., location corresponding to a casing collar location, location of special well completion elements). For example, the disclosed techniques may include receiving multiple depth-related information (e.g., completion map data and wireline tool depth measurements from surface/winch system and/or from a downhole depth/position measurement) and generating the wireline position output (e.g., the downhole tool position) using the multiple depth-related information. To illustrate this, FIG. 6 is a flow diagram of a method 60 for generating a wireline position output. Although the method 60 has been described as being performed by the processor 24 of the wireline shifting tool control system 22, it should be noted that any suitable processing device may perform the method 60.

As shown in the illustrated embodiment, the processor 24 receives completion map data 62. In general, the completion map data 62 includes well completion information, such as identifying various completion elements (e.g., valves, plugs, nipples, and the like) and information associated with the completion elements (e.g., location or depth in a well.). Additionally or alternatively, well completion information may include completion casing properties, such as segment length, diameter, thickness, and the like. In some embodiments, well completion information may include shifting tool information, such as one or more details relating to parameters of the downhole shifting tool. The one or more details relating to the parameters of the downhole shifting tool may include pipe starting depth, length of this shifting tool, outer diameter of the wireline shifting tool, information associated with anchors and/or linear actuators, and the like. In some embodiments, the completion map data 62 may be data stored in a table format.

At block 64, the processor 24 generates a processed completion map 68. In general, the processed completion map 68 may include a graphical representation of the parameters of the completion map data 62. For example, the processed completion map 68 may include data used for depicting the downhole shifting tool. As such, the processor 24, in response to generating the processed completion map 68, may cause a display to display a graphical user interface (GUI) that includes the graphical representation of the processed completion map 68.

At block 70, the processor generates a wireline position output 74. As shown in the illustrated embodiment the processor 24 may receive one or more wireline depth measurements, which may be combined with or otherwise used in conjunction with the processed completion map 68 to generate the wireline position output 74. As such, the wireline position output 74 is generally composite based on the processed completion map 68 and the one or more wireline depth measurements. In general, the one or more wireline tool depth measurement 72 may include a winch depth measurement, the correlation tool measurement, tension on the cable, the opening diameter of the anchor, the shifter opening force, the hydrostatic pressure measurement, the tractor displacement, and the like.

In some embodiments, the processor 24 may utilize each of the one or more depth measurements 72, processed completion map 68 (e.g., the completion map data 62) to compute real-time and display the position of the wireline shifting tool within the completion. The real-time depth of the anchor and shifter may be highlighted to make it easier for a user (e.g., the wireline engineer) to locate the wireline shifting tool within the completion and for him to quickly seek and engage the valve latching profile. Because the location of interest is the location of the wireline shifting tool, it is represented fixed on the screen and the completion cylindrical representation appears to be moving up or down. However, it should be noted that this is the opposite and the wireline shifting tool is moving inside the completion which is fixed.

At least in some instances, the completion map data may include a completion table (e.g., provided via user input). In such embodiments, the wireline position output may provide a CCL recording that enables side-by-side correlation directly with a depth log (e.g., a winch depth measurement or wireline tool depth measurement). In certain embodiments, the wireline position output may cause a GUI or display to display details of a well completion mapping and a shifting tool string (e.g., including the wireline shifting tool) on a graph, and thus the GUI may visualize the relative locations of the tool string, the shifting target, and the collar joints in real time and making the depth control intuitive and straightforward. In certain embodiments, the wireline position output may facilitate processing and report preparation associated with a shifting service, thereby streamlining and simplifying operation procedures, eliminating or reducing the typical human errors observed earlier, and greatly reducing the burden on the field engineers for post-job deliverables with automated real-time data collection, processing, and report generation. In certain embodiments, aspects of the present disclosure include techniques for adjust a position of the wireline shifting tool and/or latching the wireline shifting too.

Figures 7, 8:
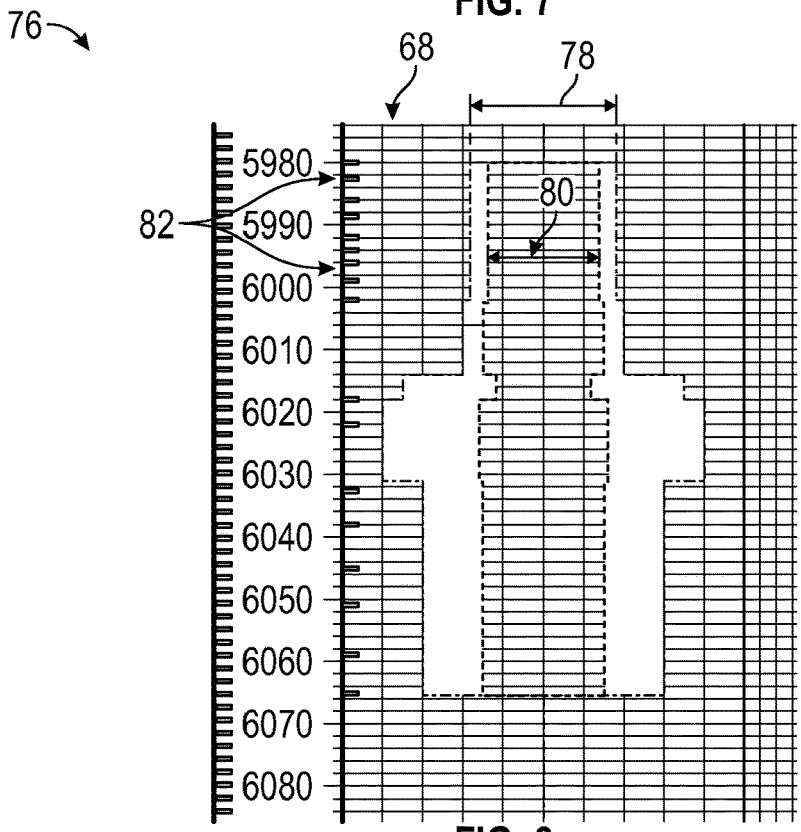
FIG. 7 is screenshot of a graphical user interface (GUI) displaying an example of completion map data, in accordance with aspects of the present disclosure.
FIG. 8 is a screenshot of a GUI displaying a first example of processed completion map, in accordance with aspects of the present disclosure.

As discussed above, the completion map data 62 may include data stored in tabular format. To illustrate one example of this, FIG. 7 shows the completion map data 62 stored in a tabular format for determining the wireline position output 74 in accordance with the present disclosure. As shown in the illustrated embodiment, the completion map data 62 may include an inner diameter (ID) of a section of well including a wireline shifting tool, an outer diameter (OD) of the section of the well, a number of repeated components for the section (e.g., number of repeated casing segments), description data indicating a component type, and a depth (e.g., the top depth for a given section) of the component. It should be noted that the completion map data 62 may include any combination of such data, as well as other relevant data for wireline shifting operations. In any case, the processor 24 may use the completion map data 62 to generate a processed completion map 68.

In general, the processed completion map 68 is a visual representation built using the completion map data 62. To illustrate this, FIG. 8 shows a screenshot 76 of a GUI displaying a processed completion map 68 that corresponds to cross section of a well associated with the completion map data 62 of FIG. 4. In certain embodiments, the processor 24 may cause the display 30 of the wireline shifting tool control system 22, or other suitable device having a display (e.g., a laptop, tablet, smart phone), to display a window that include the processed completion map 68. As illustrated, the screenshot 76 includes a y-axis corresponding to a depth within a borehole and an x-axis corresponding to a position within the borehole that is substantially perpendicular to the depth (e.g., a width). Furthermore, the well corresponding to the processed completion map 68 has an inner diameter 78 and an outer diameter 80 corresponding to the ID and OD of the completion map data 62 described with respect to FIG. 4. As illustrated, the screenshot 76 also includes processed completion map collar locations 82 corresponding to a position of a casing collar. The screenshot 76 also includes textual descriptions of the well components (i.e., corresponding to the descriptions described with respect to FIG. 4) and their corresponding depths along the well. In this way, the screenshot 76 may transform different data types into a visualization of multiple components of the well and the casing collars that is more discernable to a user, and thus may improve the efficiency of certain oil and gas operations.

Figure 9:
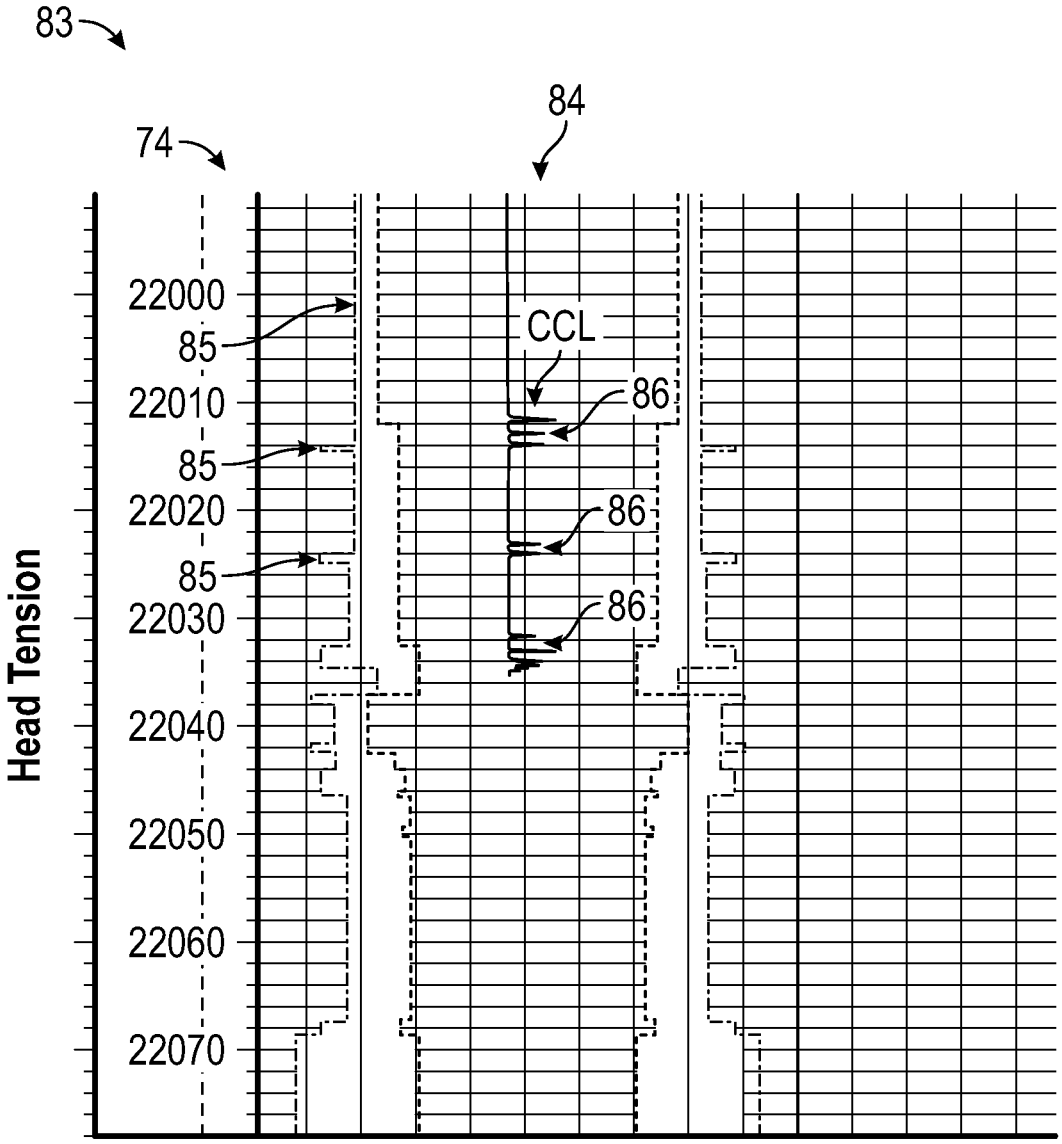
FIG. 9 is a screenshot of a GUI displaying a first example of data corresponding to the wireline position output, in accordance with aspects of the present disclosure.

As discussed above, the processor 24 may generate a wireline position output 74 that made include data used to represent a composite image based on the processed completion map 68 and the wireline tool depth measurements 72. To illustrate this, FIG. 9 is a screenshot 83 of a GUI displaying data corresponding to the wireline position output 74. As generally described herein, in certain embodiments, the wireline position output 74 may be a composite image of a CCL log 84 and the processed completion map 68 (e.g., as described above with respect to FIG. 8). In a generally similar manner as described with respect to FIG. 8, the processed completion map collar locations 82, corresponding to the processed completion map (e.g., the processed completion map 68 described above with respect to FIG. 8) may correspond to characteristics of a well, such as locations of components of the well and/or casing collar locations.

Figure 10:
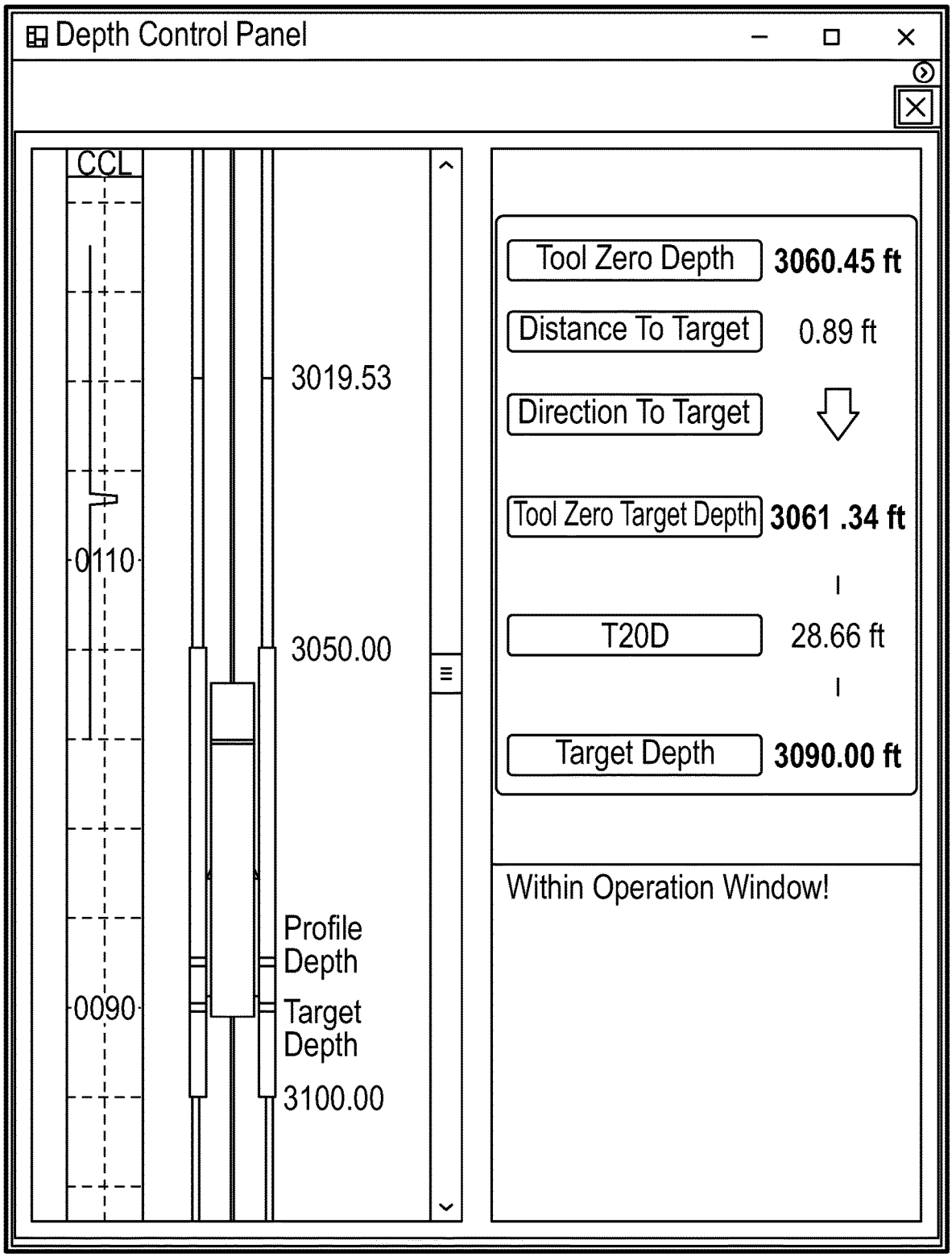
FIG. 10 is a screenshot of a GUI for assisting winch pull seeking, in accordance with aspects of the present disclosure.

In certain instances, there may be an offset between the CCL log 84 (e.g., the wireline position output) and the completion mapping. To adjust for the offset, the GUI may be configured to enable a user (e.g., an operator) to adjust the winch depth measurement to remove the offset, via a simple button click on the user interface (UI). It is presently recognized that in instances where a CCL reference log is not available, this could be an effective alternate for depth correlation. In the illustrated embodiment, the CCL log 84 aligned along the center of the processed completion map. Furthermore, the CCL log markings 86 are at approximately the same depth as the markings 85 correspond to the processed completion map, thus indicating a fit between the CCL reference log and the completion map data. Furthermore, the CCL log clearly indicates each well ID or OD change in the log, due to the highly sensitive CCL sensor used downhole. In this way, by generating a wireline position output 74 based on a combination of the well completion map data 62 and the one or more wireline measurements, a user (e.g., an operator) can monitor the downhole tool string position and speed in the well, real time and all the time. Moreover, the GUI may display the depth control panel illustrated in FIG. 10. Accordingly, the techniques may improve monitoring the tool string position and speed in the well, real time and all the time. These advanced software features simplify the operation of conveying the tool to the desired target depth and reduce the risk of missing completion joints, by replacing manual paper and pencil method.

To further illustrated the processor generating the wireline position output 74, FIGS. 11A-11C shows various screenshots of a GUI displaying a processed completion map 68, wireline tool depth measurements 72 (e.g., including a CCL log 84), and the wireline position output 74. More specifically, FIG. 11A shows a screenshot 90 a GUI displaying the processed completion map 58. FIG. 11B shows a screenshot 92 of a GUI displaying the wireline tool depth measurements 72 including the CCL log 84. FIG. 11C shows a screenshot 94 of a GUI displaying the wireline position output 74 that is generally a composite image of the embodiments described with respect to FIGS. 11A and 11B. As shown, the position of the wireline shifting tool 14 with respect to the tubular 95 of the well is computed thank to the numerous sensors of the wireline system. The measurements that are used includes the winch depth measurement, the correlation tool measurement, tension on the cable, the opening diameter of the anchor, the shifter opening force, the hydrostatic pressure measurement, the tractor displacement, and the like. The processor 24 may use at least a portion of the information to compute real-time and display the position of the shifting tool within the completion. The real-time depth of the anchor and shifter are highlighted. To make it easy for the user (e.g., a wireline engineer) to locate the wireline shifting tool 14 within the completion and for the user to quickly seek and engage the valve latching profile.

Figure 12:
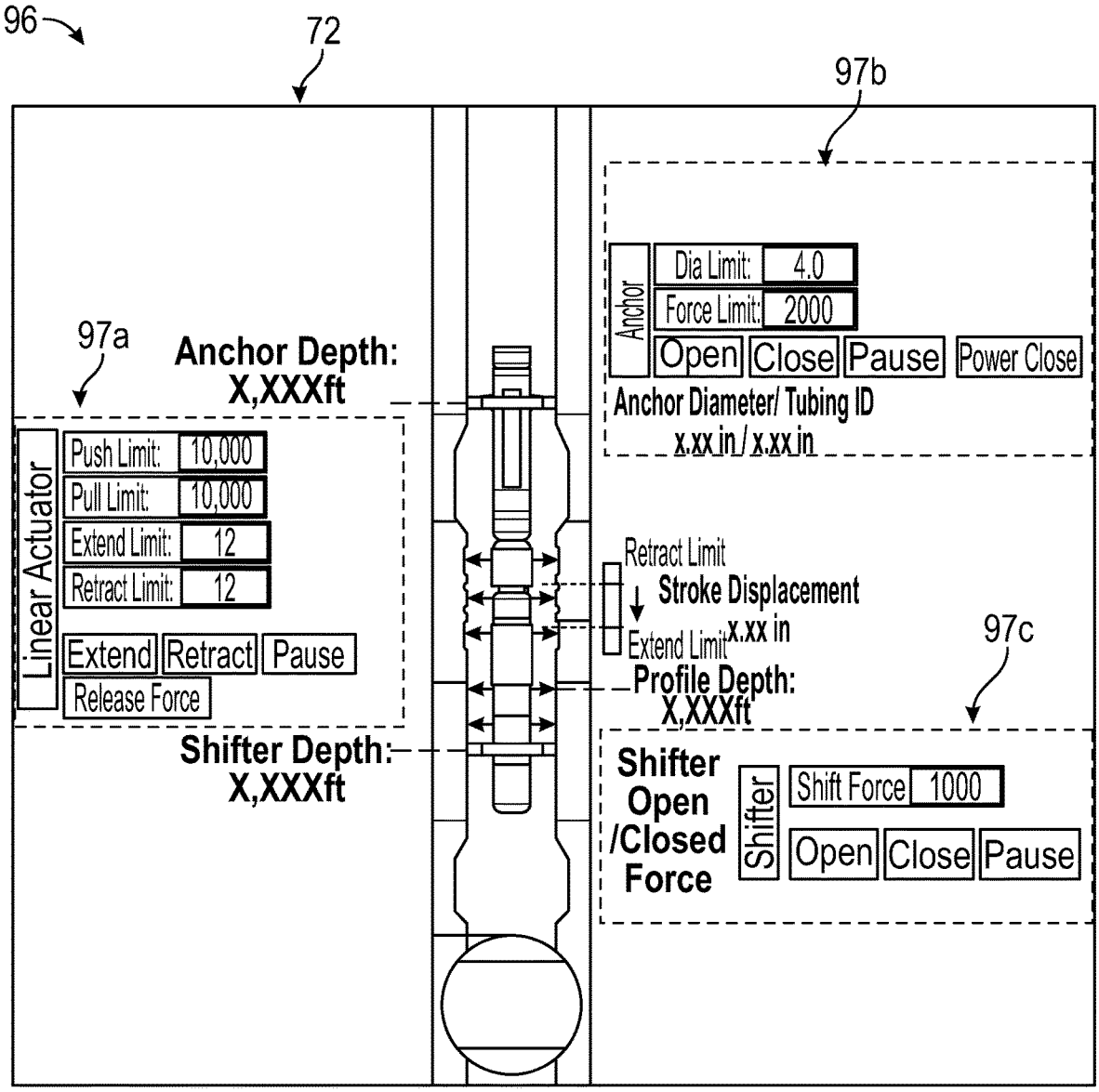
FIG. 12 is a screenshot of a GUI displaying an interface for adjusting shifting parameters, in accordance with aspects of the present disclosure.

In some embodiments, the wireline position output 74 may cause a display to generate a GUI that provides additional information regarding the wireline shifting tool 14 and selectable features to adjust the position of the wireline shifting tool 14, update information related to the wireline shifting tool 14, and the like. To illustrate this, FIG. 12 shows a screenshot 96 of a GUI displaying the wireline position output 74 with selectable features 97*a*, 97*b*, and 97*c*. In general, the selectable features include a linear actuator selectable features 97*a* to facilitate control of the linear actuator (e.g., extending, retracting, release force, and pause), anchor selectable features 97*b* to facilitate control of the anchor (e.g., open (i.e., expand), close (i.e., retract), pause, and power close), and shifter selectable features 97*c* to facilitate control of the shifter (e.g., open (i.e., expand), close (i.e., retract), pause).

In particular, the GUI of FIG. 12 represents the shifting tool within the completion equipment. In this interface the shifting tool actuators and opening mechanism are also represented. This may make it easy for the field engineer to know the state of the shifting tool. With a glance, the user may know whether the anchor is opened or if the shifter is opened or if the linear actuator is retracted or extended. The interface integrates numerous other measurements and controls. For the anchor the current opening diameter is displayed, the current anchor force is displayed. It is automatically compared to the inner diameter of the tubular that the anchor is anchoring into. The anchor controls are also integrated into the interface with the open, close and pause buttons. The anchor settings are shown with the maximum anchor opening diameter limit and the anchor force target setting. A graphical bar is also used to display the current opening of the anchor with respect to the tubing with a blue color. The color changes to orange when the anchor target force is reached.

For the linear actuator the current displacement position is displayed, the pull and push force are displayed. The linear actuator controls are integrated with the Extend, Retract, Pause, and Release Force buttons. The liner actuator settings are shown with maximum extension and retraction limits and the maximums force limits for pushing and pulling. A graphical bar is also used to display the current position of the linear actuator with respect to its max and min settings and the color turns to red when pushing and green when pulling.

For the shifter, open or close indicator is used to show if the shifter is open or closed. The shifter controls are integrated with the seek, shift, and close buttons. The shifter settings are shown with the seek and shift force setting. A graphical bar is also used to show if the shifter is open or closed and provide a visual indication (e.g., a color change, a font change, and the like) when the shift force is reached.

Figure 13:
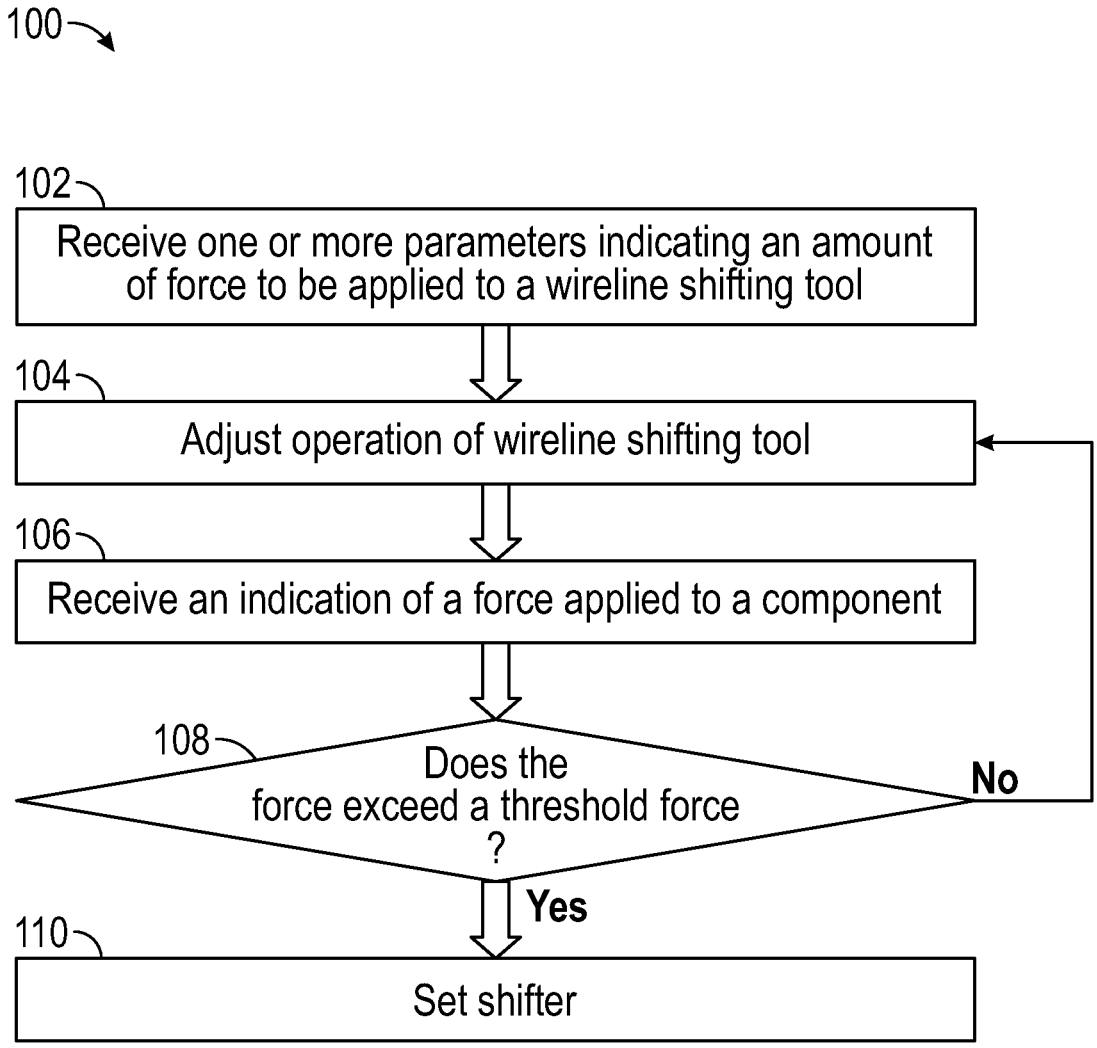
FIG. 13 is a flow diagram of a method for seeking a target profile for a wireline shifting tool, in accordance with aspects of the present disclosure.
Figure 14:
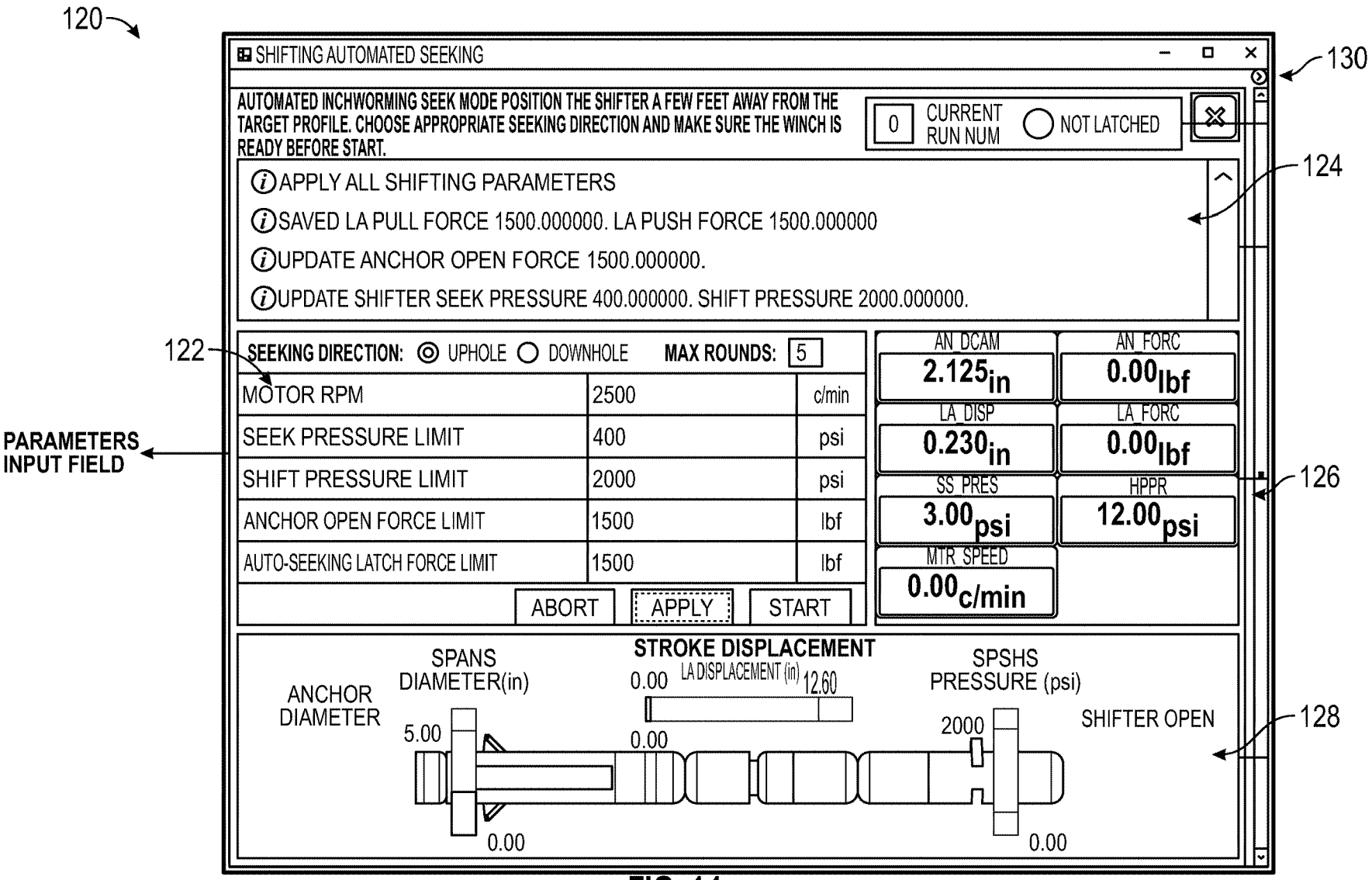
FIG. 14 is a screenshot of a GUI displaying parameters that may be used in the method of FIG. 13, in accordance with aspects of the present disclosure.

As described herein, in certain embodiments, aspects of the present disclosure are directed to improving the control of the position of the wireline shifting tool. FIG. 13 is a flow diagram of a method 100 for actuating a wireline shift tool 14, such as setting a shifter. Although the method 100 has been described as being performed by the processor 24 of the wireline shifting tool control system 22, it should be noted that any suitable processing device may perform the method 100, such as a processor of the wireline shifting tool 14.

At block 102, the processor 24 receives one or more parameters indicating an amount of force to be applied to a wireline shifting tool 14. In certain embodiments, the one or more parameters may correspond to a threshold amount of force applied by or applied to the one or more components of the wireline shifting tool 14, such as the anchor 46, the shifter device 44, the linear actuator 48, and other components described with respect to FIG. 2. In some embodiments, the one or more parameters may indicate a direction of travel (i.e., relative to the borehole) of the wireline shifting tool 14, such as upwards (e.g., more generally uphole towards the surface) or downwards (e.g., more generally downhole away from the surface). In such embodiments, the processor 24 may determine the seek direction (e.g., uphole or downhole). In some embodiments, the one or more parameters may include an anchor force close limit, an anchor diameter close limit, an anchor diameter open limit, a linear actuator pull limit, a linear actuator push limit, a linear actuator extend limit, and a linear actuator retract limit.

At block 104, the processor 24 adjusts operation of the wireline shifting tool 14 based on the one or more parameters. In general, adjusting the operation of the wireline shifting tool 14 based on the one or more parameters may include actuating one or more components, such as the linear actuator, that may cause the wireline shifting tool 14 to extend along a longitudinal direction of the borehole (e.g., along the longitudinal axis 52). For example, adjusting the operation of the wireline shift tool 14 may include actuating the linear actuator, thereby causing the linear actuator to extend.

At block 106, the processor 24 may receive an indication of the force applied to a component of the wireline shifting tool 14. In general, the indication may be data measured or acquired by a sensor indicating an amount of stress of force applied to one or more components of the wireline shifting tool 14.

At block 108, the processor 24 may determine whether the force exceeds a threshold force. For example, the memory 26 of the wireline shifting tool control system 22 may store values indicative of a threshold force. If the processor 24 determines that the force does not exceed the threshold force, then the method 100 may proceed to block 104, and thus, continuing causing the wireline shifting tool 14 to translate through the borehole.

However, if the processor 24 determines that the force exceeds the threshold force, the processor 24 may set the shifter, at block 110. In general, setting the shifter includes moving the shifter device 44 (e.g., as it is expanded) such that the shifter device 44 engages with the target position. In this way, the method 100 may provide techniques for autonomously seeking (and setting) a shifter. Furthermore, the techniques may enable a user at surface select parameters such as speed, anchoring force, shifter anchoring force, the shifter force in the expand phase and the maximum axial force in the linear actuator. At least in some instances, the operation may begin with the wireline shifting tool 14 located relatively close from the profile of the sliding sleeve (e.g., the target position). Accordingly, initial parameters (e.g., the one or more parameters as described with respect to block 102 of FIG. 13) may be transmitted (e.g., sent) from the surface to control operation of the wireline shifting tool 14 (e.g., via the wireline shifting tool control system). The parameters may trigger certain actions of the method 100. Instead of relying on the operator to monitor when an action of the sequence is complete, techniques of the method 100 include analyzing and comparing measurements from downhole sensors (e.g., pressure sensors) which are communicated to shifting tool control system. The wireline shifting tool control system may then send down the next series of commands for continuing with the next step of the operation. Accordingly, the method may enable a wireline shifting tool 14 to move in an inchworm motion without intervention from a human at surface. However, in some embodiments, the above described techniques may be fully or at least partially automated by a processor of the wireline shifting tool 14. That is, the seeking and shifting operations may be performed without sending measurements and/or commands between the downhole and the surface.

As non-limiting example of the processor 24 performing an uphole seeking process (e.g., the method 100), the processor 24 may apply user input parameters and send one or more control signals to open the shifter, auto-close the anchor, retract the linear actuator, set a value indicating the displacement of the linear actuator to an initial value (e.g., 0). Furthermore, the processor 24 may perform operations such as sending one or more control signals to open the anchor, setting the shifter in seek mode, or determining when the seek pressure drops below a threshold (e.g., below 310 psi, 300 psi, 290 psi, 280 psi, 270 psi, or below 260 psi). Furthermore, the processor 24 may perform operations such as sending one or more control signals to set the linear actuator extend limit to a first extend limit threshold (e.g., 0.5 cm, 1 cm, and 1.5 cm), and causing the linear actuator to extend. Furthermore, the processor 24 may perform operations such as sending one or more control signals to set the linear actuator extend displacement to a value (e.g., greater than 20 cm, 25 cm, 30 cm, or greater than 30 cm), providing a limit (e.g., pushing) to the user input value and extending the linear actuator one or more additional times, and monitoring the seeking related parameters until the tool stops extending. If the shifter latches to the profile, the processor 24 determines that the automated seeking reached the goal and may maintain the status. If the shifter is not latched, the process 100 may be repeated.

Figure 15:
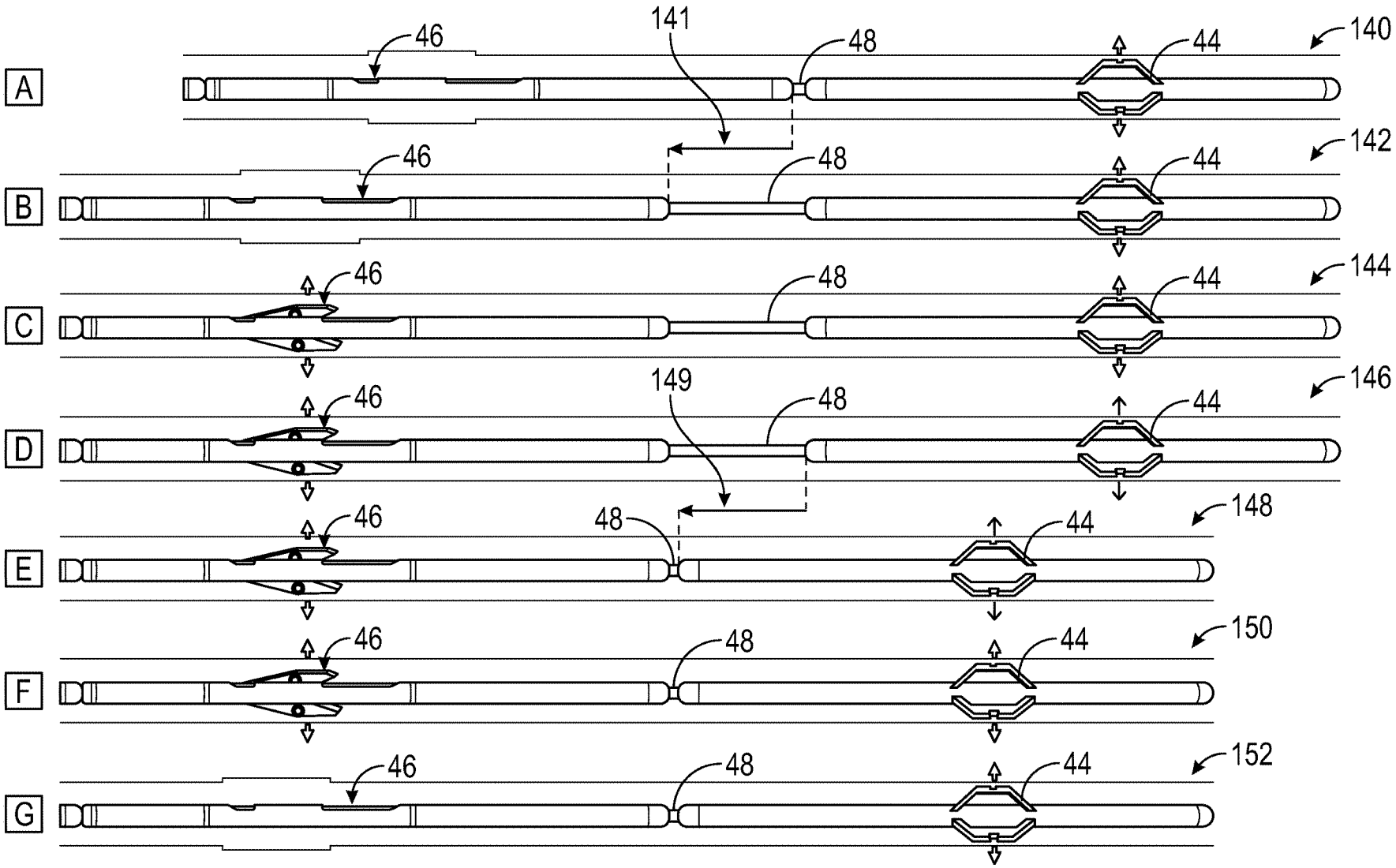
FIG. 15 shows shifting tool positions of a wireline shifting tool corresponding to the method of FIG. 13, in accordance with aspects of the present disclosure.

As non-limiting example of the processor 24 performing a downhole seeking process (e.g., the method 100), the processor 24 may perform operations such as applying user input parameters, opening the anchor, retracting the linear actuator, setting the linear actuator's displacement to zero, fully extending the linear actuator, opening the anchor, starting the shifter in seek mode (e.g., performing the seek operation generally described with respect to the method 100 of FIG. 15) and pausing to wait for the pressure drop below a threshold (e.g., below 310 psi, 300 psi, 290 psi, 280 psi, 270 psi, or below 260 psi). If the seek direction is downhole, the processor 24 may perform operations such as identifying one or more parameters associated with operation of the wireline shifting tool 14, such as a motor target speed, an anchor force open limit, a seek pressure limit, a shift pressure limit, a linear extension force limit, or a combination thereof. Furthermore, the processor 24 may perform operations such as sending one or more control signals to set the retract limit for linear actuator to 0.3 inch and the pull force limit to the user input value and then retracting (e.g., partially or fully) the linear actuator. Furthermore, the processor 24 may perform operations such as monitoring the seeking related parameters until the tool stops retracting. If the shifter latches to the profile, automated seeking reaches the goal and maintain the status. If the shifter is not latched, the process 100 may be repeated.

In certain instances, the processor 24 may execute a pause command to the tool to freeze all the operations and output error message to the user. In certain embodiments, the method 100 may be used to automatically shift the sliding sleeve by selecting a linear actuator axial force limit above the force that would cause the sliding sleeve coupled to the shifter (i.e., specifically, the shifter profile of the shifter couple to the target profile of the sliding sleeve) to shift. In this case the wireline shifting tool may automatically seek, latch and shift the sliding sleeve. In any case, the user interfaces used for a wireline shifting tool may include an avatar of the downhole tool and the surrounding completion.

For example, a first interface may be displayed to facilitate determining exact location of the equipment to be shifted by opening, searching and latching the wireline shifting tool into a sliding sleeve profile (e.g., the target profile) of the completion. It should be noted that such an interface may make it much easier for a user (e.g., the field engineer) to locate the wireline shifting tool shifter and anchor tool within the completion.

Figure 16:
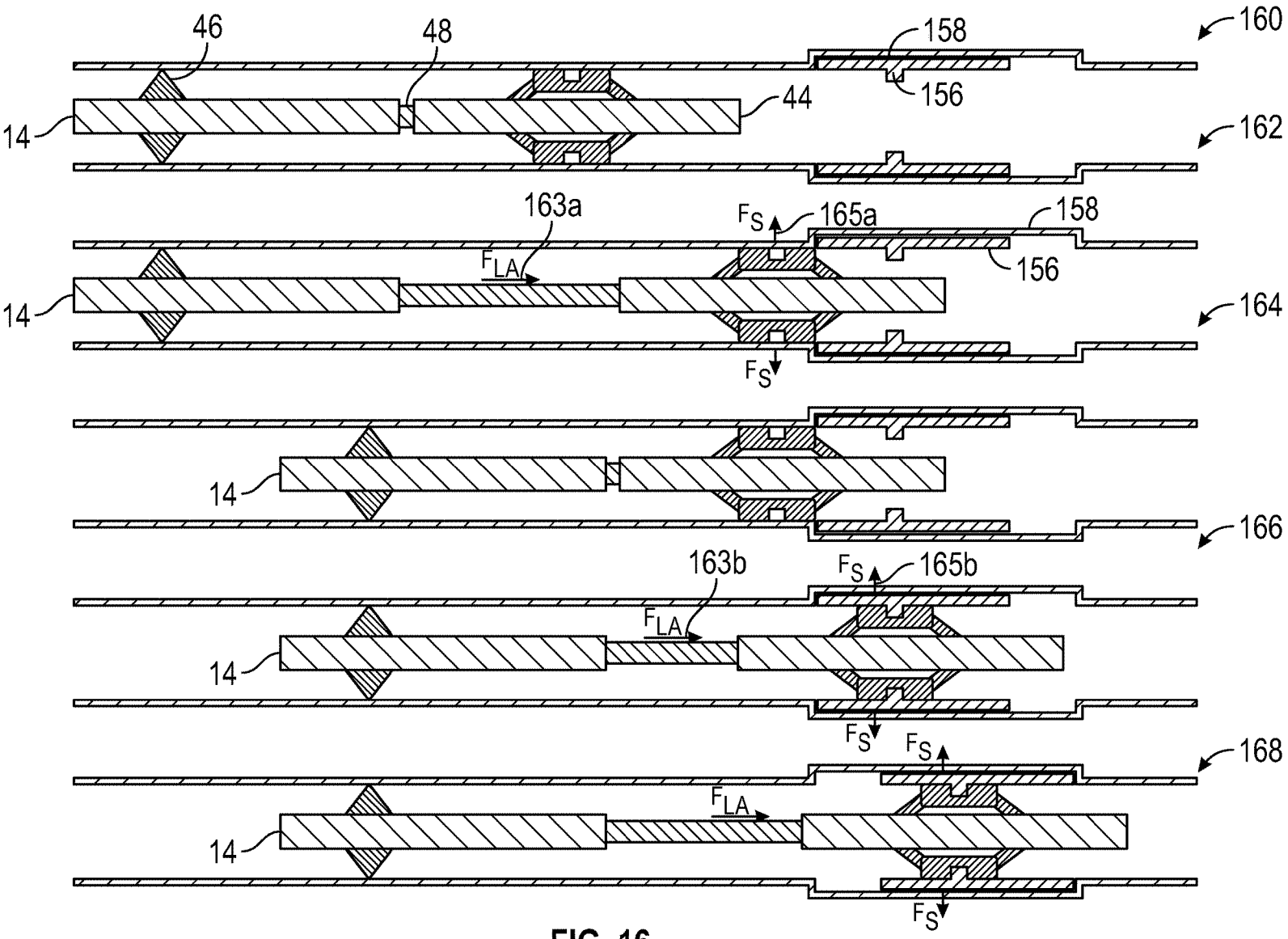
FIG. 16 shows shifting tool positions of a wireline shifting tool and forces applied by the wireline shifting tool, in accordance with aspects of the present disclosure.

As described above, the processor 24 may receive one or more parameters indicative of a force to be applied to one or more components of the wireline shifting tool 14. In some embodiments, the parameters may be received via a GUI. FIG. 16 is a screenshot 120 of a GUI for adjusting one or more parameters for controlling operation of the one or more components of the wireline shifting tool 14.

As illustrated, the GUI includes input parameters 122, an operation log 124, data gauges 126, a tool display 128, and a status indicator 130. In certain embodiments, the input parameters 122 include a motor rotations per minute, a seeking direction (e.g., uphole or downhole), a shift pressure limit (e.g., a shift pressure threshold), an anchor open force limit (e.g., an anchor open force threshold), and an auto-seeking latch force limit (e.g., auto-seeking latch force threshold). In certain embodiments, the operation log 124 may display forces used adjusting operation of the wireline shifting tool 14, such as the processor 24 applying shifting parameters, applying the linear actuator force, applying a force to open the anchor, updating a pressure applied to a shifter, or a combination thereof. In certain embodiments, the tool display 128 may depict live animation of tool operation, with radial opening and linear movement distance displaced next to the relevant element.

As described herein, with respect to FIG. 13, adjusting operation of the wireline shifting tool 14 at block 104 may cause the wireline shifting tool 14 to translate or move along a longitudinal direction of a borehole. In general, to translate along the borehole (e.g., uphole or downhole), the wireline shifting tool 14 may move between different shift positions. To illustrate this, FIG. 15 shows multiple translation positions of the wireline shifting tool 14 corresponding to the wireline shifting tool 14 translating along the longitudinal direction of the borehole, which may be referred to herein as "inchworming" or "inchworm motion". For example, and as illustrated, in a first seeking position 140, the anchor 46 is closed, the linear actuator 48 is retracted, and the shifter is expanded. As illustrated, in the second seeking position 142, the anchor 46 is closed, the linear actuator 48 is extended relative to the first seeking position 140 (e.g., in the direction 141), and the shifter is expanded. As illustrated, in the third seeking position 144, the anchor 46 is expanded, the linear actuator 48 is extended, and the shifter is expanded. As illustrated, in the fourth seeking position 146, the anchor 46 is expanded, the linear actuator 48 is retracted, and the shifter is expanded. As illustrated, in the fifth seeking position 148, the anchor 46 is expanded relative to the fourth seeking position 146 (e.g., in the direction 149), the linear actuator 48 is retracted, and the shifter is expanded. As illustrated, in the sixth seeking position 150, the anchor 46 is expanded, the linear actuator 48 is retracted, and the shifter is expanded. As illustrated, in the seventh seeking position 152, the anchor 46 is retracted, the linear actuator 48 is retracted, and the shifter is expanded. By adjusting the position of the wireline shifting tool 14 from the first seeking position 140 to, ultimately, the seventh seeking position 152, the wireline shifting tool 14 may move in the direction of the anchor 46 relative to the shifter device 44. It should be that adjusting the position of the wireline shifting tool 14 from the sixth seeking position 150 to, ultimately, the first seeking position 140, the wireline shifting tool 14 may move in an opposite direction (e.g., in the direction of the shifter device 44 relative to the anchor 46).

To further illustrate the techniques of FIGS. 12-15, FIG. 16 shows multiple seeking positions of the wireline shifting tool 14 as the processor 24 is seeking the target profile 156 of the target position 158 (e.g., along a sliding sleeve). In particular, FIG. 16 illustrates forces applied by the linear actuator 48 (e.g., $F_{LA}$) and the shifter (e.g., $F_S$). As illustrated, in the first seeking position 160, the linear actuator 48 is in a retracted position, which generally corresponds to the first seeking position 140 described with respect to FIG. 15. In the second seeking position 162, a first $F_{LA}$ force 163*a* is applied to the linear actuator 48, causing the linear actuator to extend, and thereby positioning the shifter device 44 proximate to the target position 158. The shifter may apply a first $F_S$ force 165*a* to the well. In some embodiments, the processor 24 may receive a measurement corresponding to the first $F_{LA}$ force 163*a* and/or the first $F_S$ force 165*a* and compare the first $F_{LA}$ force 163*a* and/or the first $F_S$ force 165*a* to a threshold force (e.g., a threshold $F_{LA}$ force and/or a threshold $F_S$ force) as described with respect to block 108 of FIG. 13.

As illustrated, in the third seeking position 164, the linear actuator 48 is in a retracted position, which generally corresponds to the fifth seeking position 148 described with respect to FIG. 15. Accordingly, the wireline shifting tool 14 in the third seeking position 164 may be in a different location (e.g., uphole or downhole) relative to the first seeking position 160. In the fourth seeking position 166, a second $F_{LA}$ force 163*b* is applied to the linear actuator 48, causing the linear actuator to extend, and thereby positioning the shifter device 44 proximate to the target position 158. The shifter device 44 may apply a second $F_S$ force 165*b* to the target (e.g., valve, sliding sleeve, safety valve, and the like). It should be noted that the anchor 46 may be retract, as the position of the wireline shifting tool 14 is adjusted from the third seeking position 164 to the fourth seeking position 166. In some embodiments, the processor 24 may receive a measurement corresponding to the second $F_S$ force 165*b* and compare the second $F_S$ force 165*b* to a threshold $F_S$ force. If the second $F_S$ force 165*b* is below a threshold, the processor 24 may cause the wireline shifting tool 14 to adjust to the fifth seeking position 168, thereby shifting the target.

Figure 17:
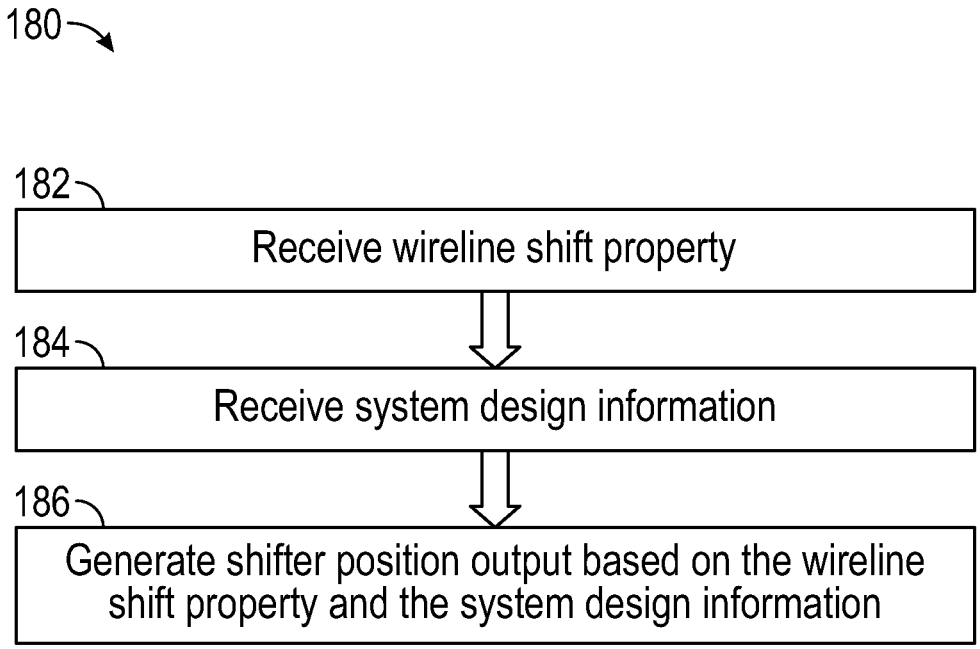
FIG. 17 is a flow diagram of a method for generating a shifter position output, in accordance with aspects of the present disclosure.

FIG. 17 is a flow diagram of a method 180 for generating a shifter position output based on a wireline shift property and system design information. Although the method 180 has been described as being performed by the processor 24 of the wireline shifting tool control system 22, it should be noted that any suitable processing device may perform the method 180.

It should be noted that in the seeking described with respect to FIGS. 13-16, a force reading (e.g., measurement) from the linear actuator in a different stage of seeking operation can help engineer or software, in the case of automated seeking, to decide if the shifter is correctly latched. This may not otherwise be applicable when the seeking operation is performed with winch pull, since the linear actuator is not used for moving the shifter through the profile. In any case, knowing the shifter open diameter (e.g., corresponding to a distance the shifter device 44 is expanded relative to the center of the wireline shifting tool 14) may be useful to indicate the shifter's position. However, it may be difficult to directly measure the shifter open diameter. Accordingly, one aspect of the present disclosure is directed to determining a shifter position output, which may include the shifter open diameter.

Accordingly, and referring to the method 180 of FIG. 17, at block 182, the processor 24 may receive data indicating a target pressure corresponding to expansion of the shifter device 44. At block 184, the processor 24 may receive system design information. In general, the system design information may indicate dimensions of the well and/or the target position. For example, the system design information may indicate a maximum and minimum diameter along one or more sections of the well. At block 186, the processor 24 may determine the shifter position output, which may include determining inner open diameter based on the data indicating the target pressure and/or the system design information.

Figure 18:
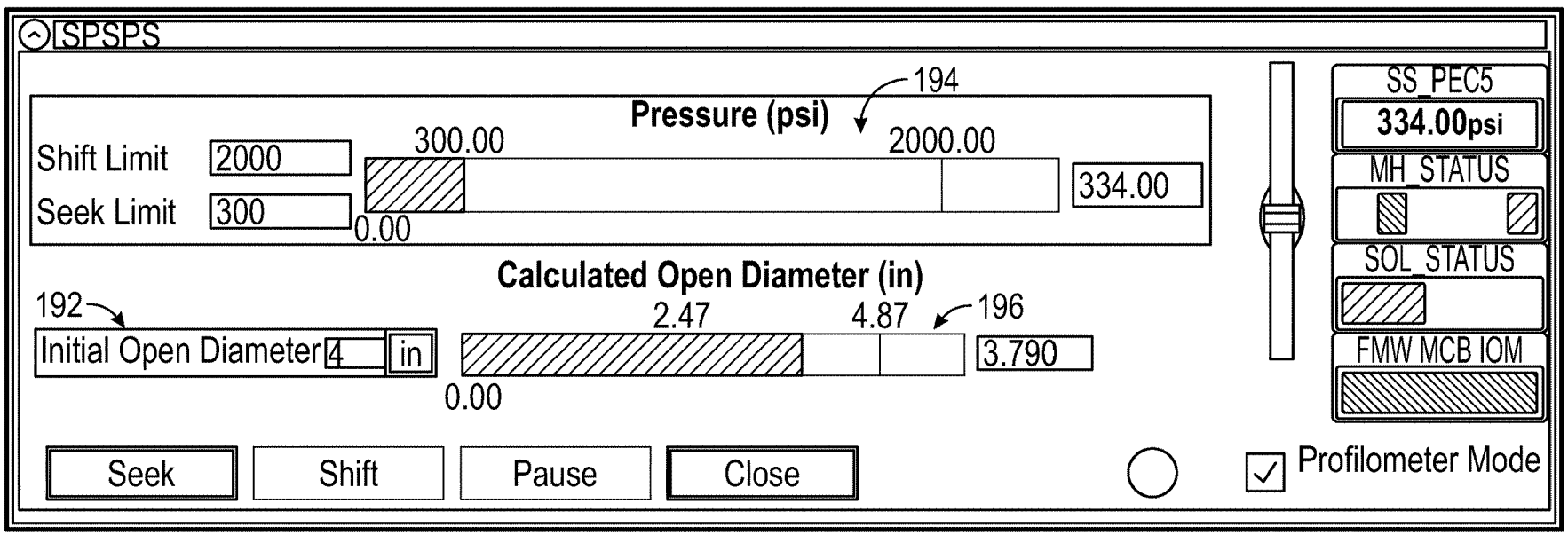
FIG. 18 is a screenshot of a GUI displaying pressure used to generate the shifter position output, in accordance with aspects of the present disclosure.

In some embodiments, the shifter position output may include the processor 24 causing a GUI to display information generally related to a profile (e.g., cross-sectional dimensions) of the wireline shifting tool 14. To illustrate this, FIG. 18 is a screenshot 190 of a GUI that may inform a user of the profile of the wireline shifting tool 14. For example, the GUI may include an initial open diameter 192, a measured pressure 194 corresponding to the shifter device 44, and a calculated diameter 196 (e.g., the inner open diameter).

Additional aspects of the disclosure relate to generating an operational report. In general, for either on-the-job troubleshooting or after-job deliverable preparation, it may be advantageous for a user to have information indicating context of operation, look at the various data channels on the log, try to interpret the events and make the necessary annotation on the log. This process may be labor intensive, time consuming, and error prone. To address this issue, an automated real-time reporting tool is built into the surface software as part of integral shifting workflow, which generates an operation report. In some embodiments, a data interpretation module may be designed and implemented to mimic what the engineer used to do: correlate the tool operational status with relevant data channels from the downhole tools, interpret and record key operational events together with essential real time measurements at the events. Accordingly, the processor 24 may generate an operational report that tabulates the events and related information per event in chronological order, real time during the job. The operational report may also available after the job, as part of the job deliverables. In any case, the processor 24 may save and store an electronic copy of the table as pdf file or print it as hard copy for future reference.

Figure 19:
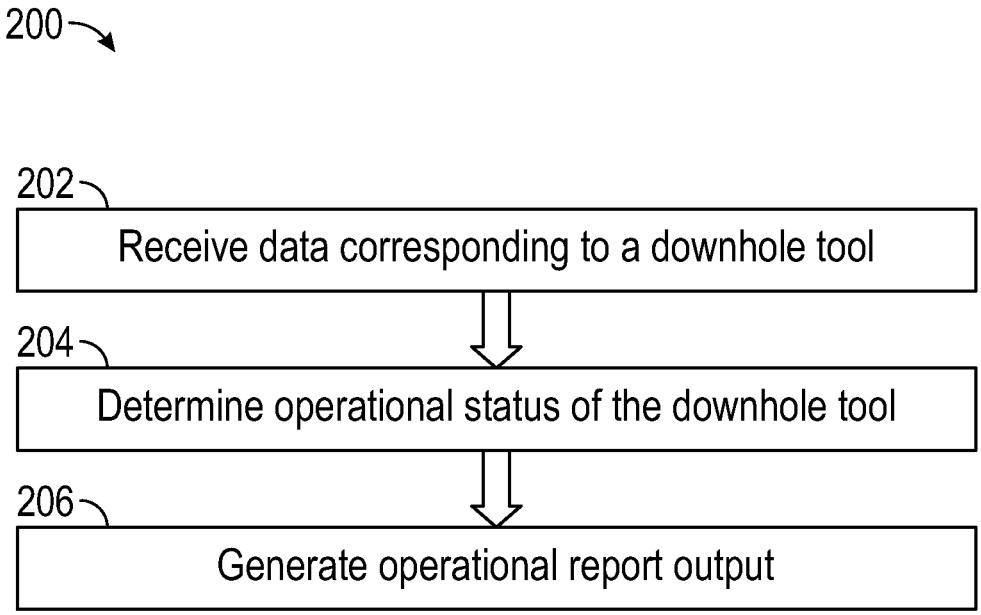
FIG. 19 is a flow diagram of a method for generating a wireline operational report, in accordance with aspects of the present disclosure.

To illustrate this, FIG. 19 is a flow diagram of a method 200 for generating an operational report output based on a data associated with a downhole tool. Although the method 200 has been described as being performed by the processor 24 of the wireline shifting tool control system 22, it should be noted that any suitable processing device may perform the method 200.

At block 202, the processor 24 may receive data corresponding to a downhole tool, such as the wireline shifting tool 14. At block 204, the processor 24 may determine an operational status of the downhole tool based on the received data. That is, the processor 24 correlate the tool operational status with relevant data channels from the downhole tools. At block 206, the processor 24 may generate an operational report output based on the determined operational status. For example, the processor 24 may interpret and record operational events and/or real time measurements at the events into the operational report input. An example operational output is shown in FIG. 20. More specifically, FIG. 20 is a screenshot 210 of a GUI displaying a tabular format of an operational report. As illustrated, the operational report includes data such as a timestamp for an operation, an indication of the operation, a downhole tool associated with the operation, an operation status, and one more measured parameters of the associated downhole tool. More specifically, the first event type 212 is the operation of the shifting modules, such as opening/closing anchor, extending/retracting linear actuator, and seeking/shifting with shifter. The second event type 214 is the updates of the completion component information, such as manufacturer, part number, size of any completion component in the well. These updates are necessary when the operating engineer or client noticed error in the completion mapping input information. The third event type 216 is the start/stop of the station log, which correlates the operation events with the relevant station log graphs.

A further aspect of the present disclosure is directed to an automated, or semi-automated, process for flushing one or more solenoids. That is, in some instance a solenoid of the wireline shifting tool may become clogged, which causes inability to control hydraulic pressure in the system and ends up with the tool modules not operating properly, such as not being able to open the anchor, or not being able to move the linear actuator. Often time the solenoids can be unclogged without opening the tools. Instead, toggling the solenoids on and off while the motor is running and trying to build up pressure in the tool, can flush the debris away from the solenoids and resume normal tool functionality. In certain embodiments, it may be desirable to manipulate the solenoids in defined sequence to achieve the flushing purpose. This may require the user to control the motor and each solenoid one by one, step by step. The process is time consuming and error prone.

Figure 21:
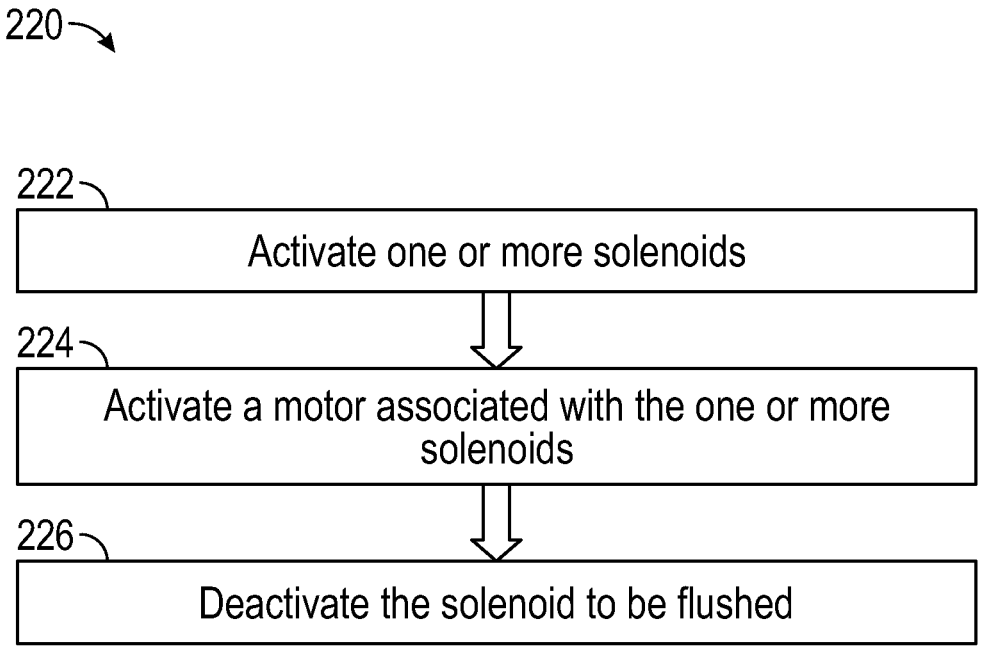
FIG. 21 is a flow diagram of a method for adjusting operation of a solenoid, in accordance with aspects of the present disclosure.

Accordingly, FIG. 21 is a flow diagram of a method 220 for flushing a solenoid. Although the method 220 has been described as being performed by the processor 24 of the wireline shifting tool control system 22, it should be noted that any suitable processing device may perform the method 220.

Figure 22:
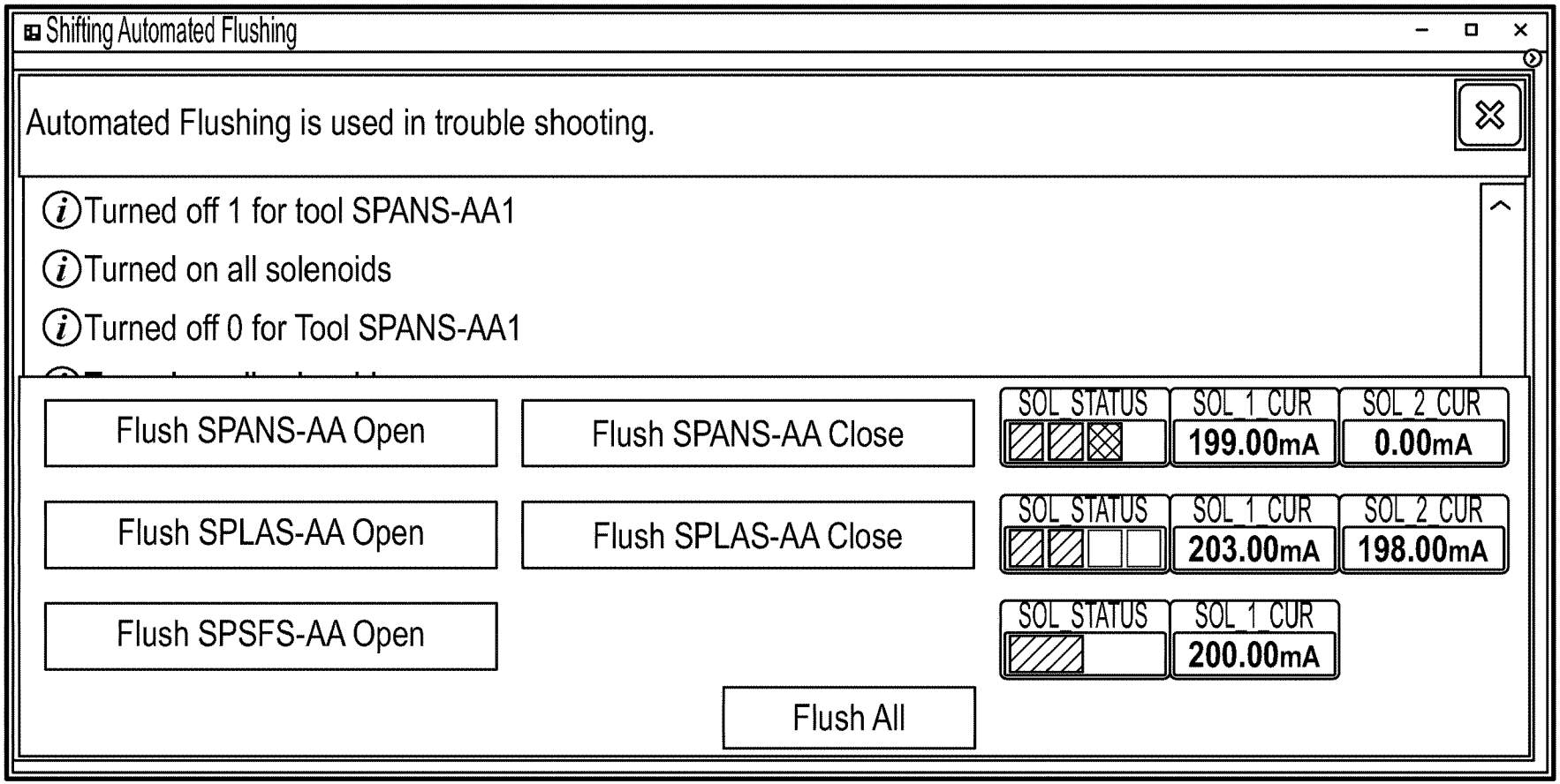
FIG. 22 is a screenshot of a GUI displaying selectable features for performing a solenoid flush, in accordance with aspects of the present disclosure.

At block 222, the processor 24 may activate one or more of the solenoids. At block 224, the processor 24 may activate a motor, which builds pressure on a hydraulic bus to a threshold pressure (e.g., greater than 7000 psi, greater than 7200 psi, greater than 7500 psi). At block 226, the processor 24 may deactivate a particular solenoid to be flushed. That is, the processor 24 may identify the solenoid that is clogged (i.e., the clogged solenoid), and subsequently deactivate the clogged solenoid at block 226. In this way, the method 220 may enable flushing of a solenoid in an automated or semi-automated manner. At least in some instances, a GUI may be implemented to enable a user to provide input and/or receive feedback associated with the flushing of the solenoids. For example, a GUI interface may be generated during software run-time to represent the proper solenoid configuration for the specific tool string composition. When tool string changes, such as adding or removing an anchor, the GUI may update accordingly to add or remove solenoid inside the anchor. An example of a GUI for performing a solenoid flush operation is shown in FIG. 22.

The advanced software features presented here are essential to address some long-standing challenges for wireline shifting services. These features mainly aim to automate the critical steps of shifting operational workflow. The automation helps to greatly improve the reliability, efficiency, and service quality of the wireline shifting jobs. In certain embodiments, one-click operation may be utilized to control a shifting operation. In such embodiments, a fully automated tool conveyance over the wireline may be utilized. So, the automated winch operation may be incorporated into the workflow. More intelligent decision-making method may be used to identify different phases of the operation. For example, AI based pattern recognition can be used to confirm successful latching to the target, by analyzing real-time force vs displacement waveform using pre-trained algorithm. Further improvement on linear actuator displacement measurement is going to be beneficial too, to allow micro-level correlation with sub-millimeter grade accuracy. This can potentially be achieved by fusing multiple measurements, including the accelerometer measurement, the tractor speed, the pumping motor speed of the shifting tool, and the winch depth measurement.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a wireline shifting tool comprising an anchor, a linear actuator, and a shifter; and a wireline shifting tool control system configured to:

receive one or more measurements associated with the wireline shifting tool;

apply a first force to the linear actuator of the wireline shifting tool causing the linear actuator to extend;

receive an indication of a second force applied to the shifter of the wireline shifting tool;

determine that the second force applied to the shifter is below a threshold;

determine that the shifter is proximate to a target position based on the second force being below the threshold; and latch the shifter to the target position based on the determination that the shifter is proximate to the target position wherein the one or more measurements comprise completion map data, and wherein the wireline shifting tool control system is configured to cause a graphical user interface (GUI) to display a processed completion map and adjust operation of the wireline shifting tool based on the processed completion map.

2. The system of claim 1, wherein the wireline shifting tool comprises a smart shifting tool, a selective shifting tool, or a completion shifting tool.

3. The system of claim 1, wherein the one or more measurements further comprise a pressure applied to the anchor or the linear actuator of the wireline shifting tool; and wherein the wireline shifting tool control system is configured to cause the GUI to display pressure information related to the pressure applied to the anchor or the linear actuator.

4. The system of claim 3, wherein the wireline shifting tool control system is configured to adjust a position of the shifter of the wireline shifting tool based on the one or more measurements.

5. The system of claim 3, wherein the wireline shifting tool control system is configured to determine an open diameter of the shifter based on the second force and to cause the graphical user interface (GUI) to display the open diameter.

6. The system of claim 1, wherein the linear actuator is configured to adjust a position of the shifter relative to the anchor, and wherein the one or more measurements are indicative of an axial force applied by the linear actuator.

7. The system of claim 1, wherein the one or more measurements comprise completion map data, and wherein the wireline shifting tool control system is configured to:

receive one or more depth tool measurements;

generate a wireline position output based on the completion map data and the one or more depth tool measurements; and cause the graphical user interface (GUI) to display information based on the wireline position output.

8. The system of claim 1, wherein the wireline shifting tool control system is configured to retract the anchor based on an anchor force limit.

9. A method, comprising:

receiving, via a processor, one or more parameters indicating an amount of force to be applied to a wireline shifting tool;

applying, via the processor, a first force to a linear actuator of the wireline shifting tool causing the linear actuator to extend;

receiving, via the processor, an indication of a second force applied to a shifter of the wireline shifting tool;

determining, via the processor, that the second force applied to the shifter is below a threshold;

determining, via the processor, that the shifter is proximate to a target position based on the second force being below the threshold; and latching, via the processor, the shifter of the wireline shifting tool to the target position based on the second force applied to the shifter being below the threshold.

10. The method of claim 9, an anchor open force limit, a latch force limit, or a combination thereof.

11. The method of claim 9, further comprising displaying, via the processor, a graphical user interface (GUI) indicating an open inner diameter of the shifter, a pressure applied by the second force, or both.

12. The method of claim 9, further comprising applying a third force causing the shifter to expand.

13. The method of claim 9, further comprising generating an operational report based on the indication of the second force applied to the shifter of the wireline shifting tool.

14. The method of claim 9, further comprising selecting a linear actuator axial force limit of the linear actuator to cause a sliding sleeve coupled to the shifter to start shifting, and latching the shifter based on the linear actuator axial force limit.

15. The method of claim 9, wherein the one or more parameters comprise a shifter diameter; and wherein the method further comprises determining a calculated shifter diameter based on the shifter diameter and the second force applied to the shifter.

16. The method of claim 8, further comprising retracting an anchor of the wireline shifting tool based on an anchor force limit.

17. A non-transitory computer-readable medium comprising computer-executable instructions that, when executed by a processor, are configured to cause the processor to:

receive one or more parameters indicating an amount of force to be applied to a wireline shifting tool;

apply a first force to a linear actuator of the wireline shifting tool causing the linear actuator to extend based on the one or more parameters;

receive an indication of a second force applied to a shifter of the wireline shifting tool;

determine that the second force applied to the shifter is below a threshold;

determine that the shifter is proximate to a target position based on the second force being below the threshold;

determine an operational adjustment to be made to the wireline shifting tool based on the second force being below the threshold;

display a graphical user interface (GUI) comprising information associated with the operational adjustment; and adjust operation of the wireline shifting tool in accordance with the operational adjustment and the information displayed on the GUI, wherein the operational adjustment comprises latching the shifter to the target position.

18. The non-transitory computer-readable medium of claim 17, wherein the instructions, when executed by the processor, cause the processor to determine the operational adjustment by selecting a linear actuator axial force limit of the linear actuator above a third force that would cause a sliding sleeve coupled to the shifter of the wireline shifting tool to shift.

19. The non-transitory computer-readable medium of claim 17, wherein the instructions, when executed by the processor, cause the processor to generate the graphic user interface (GUI) indicating an offset between the wireline shifting tool and the target position along a borehole that includes the wireline shifting tool.

20. The non-transitory computer-readable medium of claim 17, wherein the target position includes a sliding sleeve.

* * * * *